US008002208B2

(12) United States Patent
Yamada

(10) Patent No.: US 8,002,208 B2
(45) Date of Patent: Aug. 23, 2011

(54) ELECTROSTATIC COATING APPARATUS

(75) Inventor: Yukio Yamada, Fujieda (JP)

(73) Assignee: ABB K.K., Tokyo (JP)

( * ) Notice: Subject to any disclaimer, the term of this patent is extended or adjusted under 35 U.S.C. 154(b) by 976 days.

(21) Appl. No.: 11/909,330

(22) PCT Filed: May 31, 2006

(86) PCT No.: PCT/JP2006/311366

§ 371 (c)(1),
(2), (4) Date: Sep. 21, 2007

(87) PCT Pub. No.: WO2007/015337

PCT Pub. Date: Feb. 8, 2007

(65) Prior Publication Data

US 2010/0193613 A1 Aug. 5, 2010

(30) Foreign Application Priority Data

Aug. 1, 2005 (JP) ..... 2005-223153

(51) Int. Cl.
*B05B 5/00* (2006.01)

(52) U.S. Cl. ..... 239/690; 239/696

(58) Field of Classification Search ..... 239/690, 239/690.1, 436, 437, 442, 443, 706, 707, 239/225.1, 263, 696

See application file for complete search history.

(56) References Cited

U.S. PATENT DOCUMENTS

| | | | | |
|---|---|---|---|---|
| 5,156,336 | A * | 10/1992 | Hammond et al. | 239/214.25 |
| 7,143,963 | B2 * | 12/2006 | Tani et al. | 239/456 |
| 2004/0016832 | A1 * | 1/2004 | Schroeder et al. | 239/690 |

FOREIGN PATENT DOCUMENTS

| | | |
|---|---|---|
| JP | 4 74555 | 6/1992 |
| JP | 8 332418 | 12/1996 |
| JP | 10 109054 | 4/1998 |
| JP | 2001 113207 | 4/2001 |

OTHER PUBLICATIONS

U.S. Appl. No. 11/916,499, filed Dec. 4, 2007, Yamada.
U.S. Appl. No. 11/908,425, filed Sep. 12, 2007, Yamada, et al.

* cited by examiner

*Primary Examiner* — Davis Hwu
(74) *Attorney, Agent, or Firm* — Oblon, Spivak, McClelland, Maier & Neustadt, L.L.P.

(57) ABSTRACT

A housing member includes a main housing body and an intermediate tube provided around the outer periphery of the main housing body. Located in a front portion of the main housing body is an atomizer including an air motor and a rotary atomizing head, while located in a rear portion of the main housing body is a high voltage generator to apply a high voltage to paint through the air motor. A multitude of hollow cavities are uniformly formed in the intermediate tube over the entire outer surface thereof by the use of through holes opened through the intermediate tube. A cover member is fitted on the outer surface of the intermediate tube in contact with the intermediate tube, thereby intensifying electric field strength in outer corner portions of the hollow cavities to prevent deposition of charged paint particles.

20 Claims, 17 Drawing Sheets

ELECTROSTATIC COATING APPARATUS

TECHNICAL FIELD

This invention relates to an electrostatic coating apparatus which is adapted to spray paint under application of a high voltage.

BACKGROUND ART

Generally, there has been known, for example, an electrostatic coating apparatus which is constructed of an atomizer composed of an air motor and a rotary atomizing head, a housing member formed of an electrically insulating material and arranged to hold the air motor of the atomizer therein, a tubular cover member arranged to cover the outer surface of the housing member, and a high voltage generator provided with an external electrode to charge paint particles, which are sprayed forward by the rotary atomizing head of the atomizer, with a negative high voltage (e.g., see Japanese Patent Laid-Open No. 2001-113207).

In the case of the electrostatic coating apparatus provided by the prior arts, an electrostatic field is formed by lines of electric force between an external electrode, to which a negative high voltage is applied, and a rotary atomizing head which is held at the earth potential, and at the same time between the external electrode and a work piece. Besides, an ionization zone is formed in the vicinity of a nose end of the external electrode assembly.

If, in this state, the rotary atomizing head is put in high speed rotation to spray paint, paint particles sprayed from the rotary atomizing head are imparted with an electrostatic charge by a negative high voltage while passing through the ionization zone to become charged paint particles. Therefore, charged paint particles are urged to fly toward and deposit on surfaces of a work piece which is connected to the earth.

In this regard, in the case of the electrostatic coating apparatus described in Japanese Patent Laid-Open No. 2001-113207, outer surfaces of the cover member are electrified with the discharged electrostatic charge of negative polarity. Therefore, repulsions occur between the charged paint particles and the cover member of the same negative polarity, preventing paint particles from depositing on outer surfaces of the cover member. Besides, the cover member is formed of an electrically insulating material to prevent the high voltage electrostatic charge on outer surfaces of the cover member from leaking to the side of the earth potential.

However, in an actual electrostatic coating operation, paint particles start to gradually deposit on outer surfaces of the cover member as the operation is continued, accumulating as paint deposits to degrade the insulation performance of the cover member. Deposition of paint particles progresses abruptly in step with degradations in insulation quality of the cover member. Therefore, in the prior art, it is often the case that a coating operating has to be stopped frequently in order to remove paint deposits.

Further, in the case of the electrostatic coating apparatus of Japanese Patent Laid-Open No. 2001-113207 mentioned above, a water repellent paint is coated on outer surfaces of the cover member to prevent deposition of paint particles. However, a coating apparatus of this sort has a problem in that the thickness of the water repellent paint coating becomes thinner and thinner when outer surfaces of the apparatus are washed repeatedly at the end of coating operations, necessitating to coat the water repellent paint periodically. In addition, instability in quality of the water repellent paint often results in a lower yield of products and costly coating operations.

DISCLOSURE OF THE INVENTION

In view of the above-discussed problems with the prior art, it is an object of the present invention to provide an electrostatic coating apparatus having outer surfaces of a cover member stably electrified with high voltage electrostatic charges to prevent deposition of paint particles.

(1) According to the present invention, in order to achieve the above-stated objective, there is provided an electrostatic coating apparatus comprised of a paint atomizing means adapted to spray atomized paint particles toward a work piece, a housing member formed of an electrically insulating material to accommodate the paint atomizing means, a tubular cover member enshrouding outer surfaces of the housing member, and a high voltage application means adapted to impart a high voltage electrostatic charge to paint particles to deposit charged paint particles sprayed from the paint atomizing means on surfaces of the work piece.

The electrostatic coating apparatus according to the present invention is characterized by the provision of a plurality of hollow cavities formed in and sunken from outer surfaces of the housing member, and the cover member enshrouding outer surfaces of the housing member in contact with the latter and closing outer side of the hollow cavities, defining a closed space in each one of the hollow cavities.

With the arrangements just described, except the hollow cavities, the cover member which is wrapped around the housing member is held in contact with outer surface of the latter, closing the respective hollow cavities from outside to define closed spaces therein. In this regard, generally, air is lower than an electrically insulating material in specific permittivity or specific inductive capacity, so that specific permittivity in the hollow cavities (closed spaces) of the housing member differs, for example, 2 to 4 times as compared with that of contacting portions which are held in contact with the cover member. Since a multitude of hollow cavities are provided in the housing member, equipotential lines are undulated in a wavy fashion by the existence of closed spaces within the hollow cavities.

As a result, intervals between equipotential lines are narrowed and the electric field strength is intensified in the vicinity of boundaries between the inner side (closed spaces) and outer side (housing member) of the hollow cavities. The intensification of electric field strength occurs periodically at the positions of the hollow cavities. As a consequence, the electric field strength is intensified periodically also on the outer surface of the cover member, augmenting the Coulomb repulsion force which is proportional to electric field strength and effectively preventing deposition of charged paint particles.

Especially, according to the present invention, differences in specific permittivity can be utilized by way of the closed spaces within the hollow cavities, housing member and cover member. Namely, at the boundaries of the just-mentioned three component parts (the closed spaces, housing member and cover member) which have different values in specific permittivity (or in outer corner portions of the hollow cavities), equipotential lines are distorted to a greater degree to intensify the electric field strength furthermore. Thus, by employing a cover member as thin as several millimeters, boundaries of the three parts of different specific permittivity can be located at a position which is extremely close to the exterior surface of the cover member to intensify the electric field strength on the exterior surface of the cover member. As a result, deposition of charged paint particles on the cover member can be prevented effectively.

On the other hand, in a case where no hollow cavities are provided in the housing member, electrostatic charges on one and same electrified body are constantly in movement to stabilize the potential. When electrostatic charges are in movement in this manner, the electric field strength on the cover member which is in contact with the housing member comes instable, resulting in non-uniform electric field strength distribution on the entire cover member. Therefore, strong and weak spots in electric field strength appear on the exterior surface of the cover member, and charged paint particles floating in the air come to deposit on the weak spots in electric field strength in a concentrated fashion, thereafter paint deposition on the cover member progresses at an accelerated pace starting from the weak spots.

In contrast, according to the present invention, a plurality of hollow cavities are provided in the housing member, so that fluctuations in potential take place differently between contacting portions of the cover member which are in contact with the housing member and non-contacting portions of the cover member which cover the outer side of the hollow cavities (closed spaces). At this time, in the non-contacting portions of the cover member which cover the hollow cavities, fluctuations in potential take place freely in a limited area making the electric field strength non-uniform. However, fluctuations in potential are suppressed in the contacting portions of the cover member, with a trend of confining fluctuations in potential to those portions which cover the hollow cavities.

Therefore, according to the present invention, a plural number of hollow cavities are independently and uniformly distributed over the entire cover member to keep the electric field strength in a balanced state on the cover member as a whole. As a result, deposition of charged paint particles on the entire exterior surface of the cover member can be prevented.

(2) According to the present invention, the housing member is comprised of a main housing body adapted to hold the paint atomizing means and an intermediate tube interposed between outer periphery of the main housing body and the cover member, the hollow cavities being formed by way of perforations opened in the intermediate tube or bottomed holes dug into outer peripheral surface of the intermediate tube.

With the arrangements just described, the intermediate tube of a tubular shape can be formed separately of the main housing body which holds the paint atomizing means. Thus, hollow cavities can be formed easily by a boring operation, i.e., by boring bottomed holes in the intermediate tube or by perforating the intermediate tube. Besides, a material for the intermediate tube can be selected freely irrespective of the main housing body. That is to say, one can use a material with excellent insulating properties for the main housing body, while selecting a material of high specific permittivity for the intermediate tube. As a consequence, it becomes possible to magnify distortions of equipotential lines around the hollow cavities and to intensify the electric field, preventing deposition of charged paint particles in a more assured manner.

(3) According to the present invention, inner peripheral surface of the intermediate tube is disposed to confront outer peripheral surfaces of the main housing body across an annular gap space which is formed between substantially entire areas of the confronting inner and outer peripheral surfaces of the intermediate tube and the main housing body.

With the arrangements just described, the main housing body which is lower in resistance as compared with air can be mostly held out of contact with the intermediate tube to prevent leakage of high voltage electrostatic charges on the exterior surfaces of the cover member through the intermediate tube and the main housing body, maintaining the cover member in an electrostatically charged state to prevent deposition of charged paint particles.

(4) According to the present invention, a high voltage discharge electrode assembly is provided around outer periphery of the cover member to discharge a high voltage of the same polarity as the charged paint particles.

Thus, ions of the same polarity as charged paint particles are discharged from a high voltage discharge electrode assembly to electrify the cover member with an electrostatic charge of the same polarity. In addition, a high voltage electrostatic field is formed around the outer periphery of the cover member by the high voltage discharged assembly to keep charged paint particles off the cover member, and prevent deposition of charged paint particles by the cover member electrified a high voltage.

(5) According to the present invention, the high voltage discharge electrode assembly is composed of support arms extended radially outward from the cover member, a ring member supported on outer distal ends of the support arms and located periphery of the paint atomizing means in such a way as to circumvent the cover member, and an acicular or blade-like electrode member supported on and extended from the ring member in a direction away from the work piece.

Thus, an electrostatic field of high voltage can be formed periphery of the cover member by the ring member which circumvents the cover member, thereby keeping charged paint particles off the cover member. On the other hand, a high voltage is discharged from electrode members which are extended in a direction away from a work piece, so that the cover member is imparted with a high voltage electrostatic charge up to those areas which are distant from a work piece. Accordingly, deposition of charged paint particles is prevented over a broad area of the cover member.

(6) According to the present invention, the paint atomizing means is composed of an air motor accommodated in the housing member, and a rotary atomizing head rotatably supported on the air motor on the front side of the latter and provided with paint releasing edges at a front end thereof.

Thus, paint can be sprayed forward from the rotary atomizing head which is put in high speed rotation by the air motor.

(7) According to the present invention, the high voltage application means is adapted to apply a high voltage to the air motor and the rotary atomizing head, directly applying a high voltage to paint being supplied to the rotary atomizing head.

Thus, a high voltage is constantly applied to the air motor and rotary atomizing head, so that a high voltage can be directly applied to the paint which has been supplied to the rotary atomizing head. Besides, since the air motor is accommodated in the housing member, the cover member is located in such a way as to surround the air motor. That is to say, a high voltage is applied not only to the rotary atomizing head but also to the air motor, so that a high voltage can be stably built up on exterior surfaces of the cover member which circumvents the air motor, for preventing deposition of paint particles.

(8) According to the present invention, the high voltage application means is adapted to apply a high voltage to an external electrode assembly located radially on outer side of the cover member, indirectly charging paint particles with a high voltage as the latter are sprayed by the rotary atomizing head.

Thus, by the external electrode assembly, an ionization zone is formed around the rotary atomizing head for indirectly charging paint particles which are sprayed by the rotary atomizing head. Besides, by the external electrode assembly which is applied with a high voltage, exterior surfaces of the cover member are electrified stably with a high voltage to prevent deposition of paint particles.

BEST MODE FOR CARRYING OUT THE INVENTION

Figure 1:
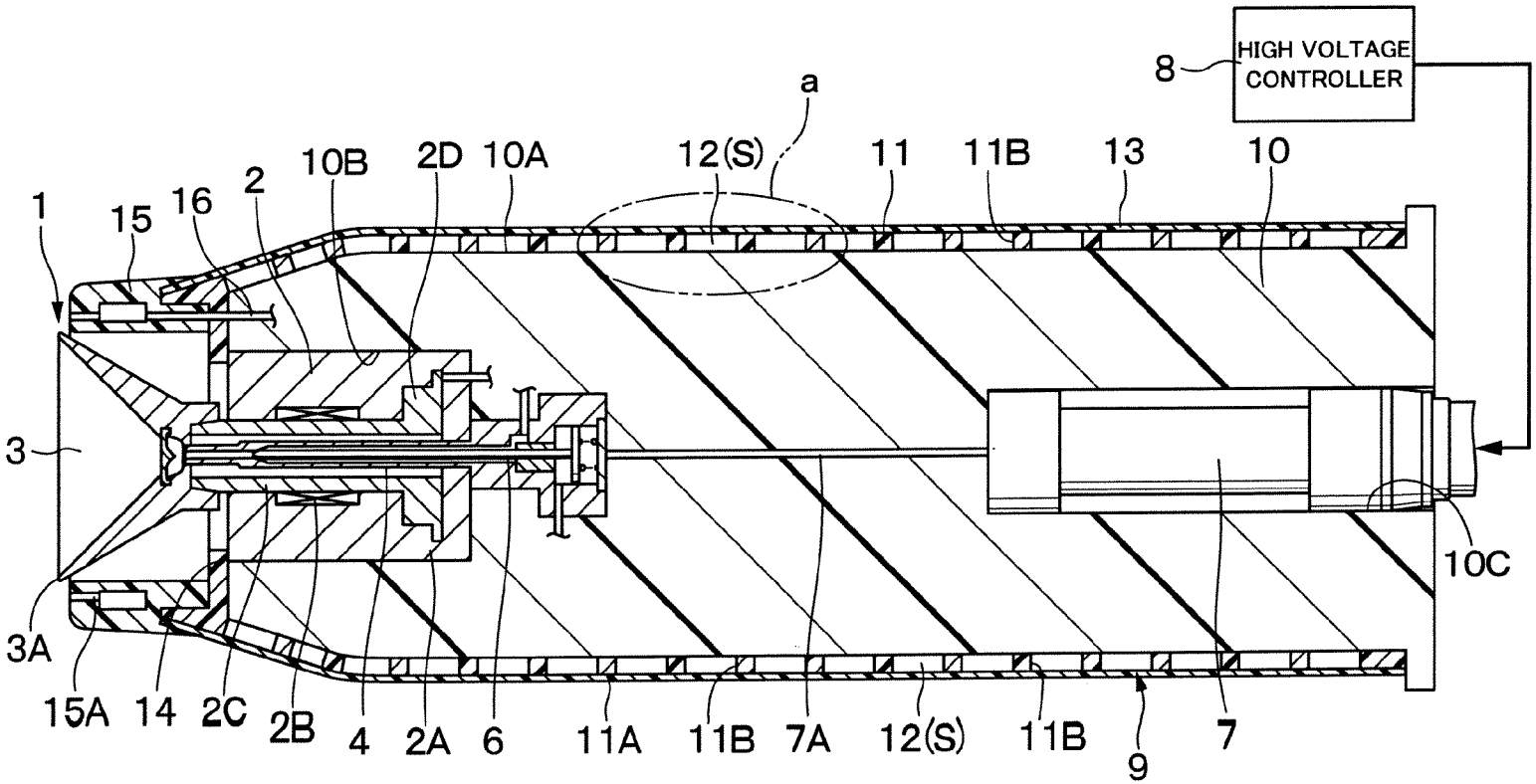
FIG. 1 is a longitudinal sectional view of a rotary atomizing head type coating apparatus according to a first embodiment of the present invention.
Figure 2:
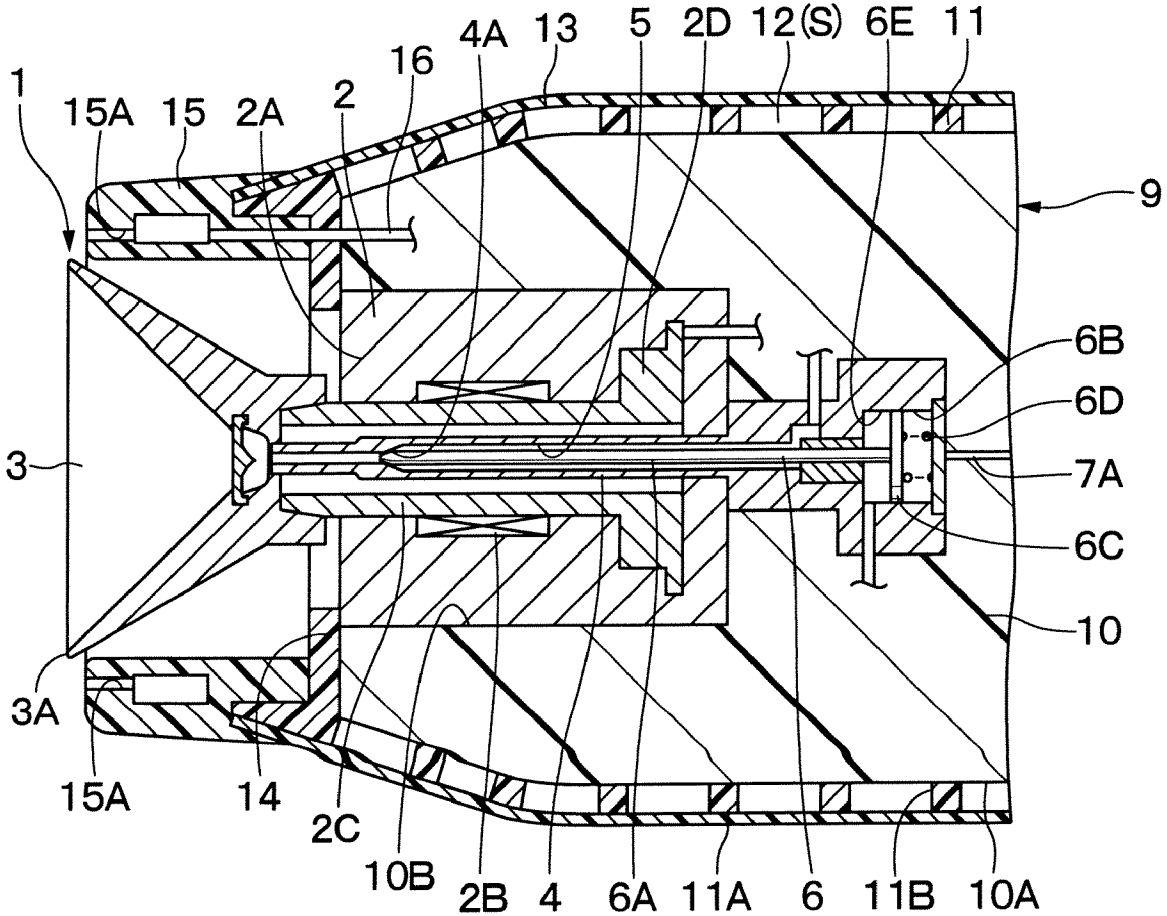
FIG. 2 is a fragmentary longitudinal section, showing on an enlarged scale an atomizer and surrounding parts on the coating apparatus of FIG. 1.
Figure 3:
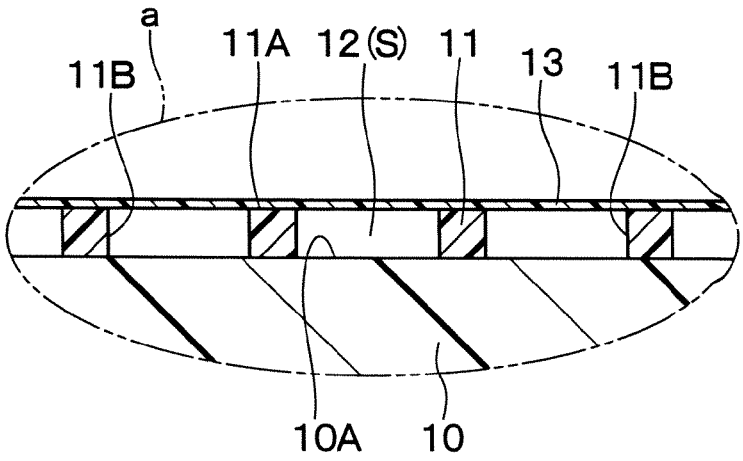
FIG. 3 is a fragmentary longitudinal section, showing on an enlarged scale a demarcated area "a" in FIG. 1.
Figure 4:
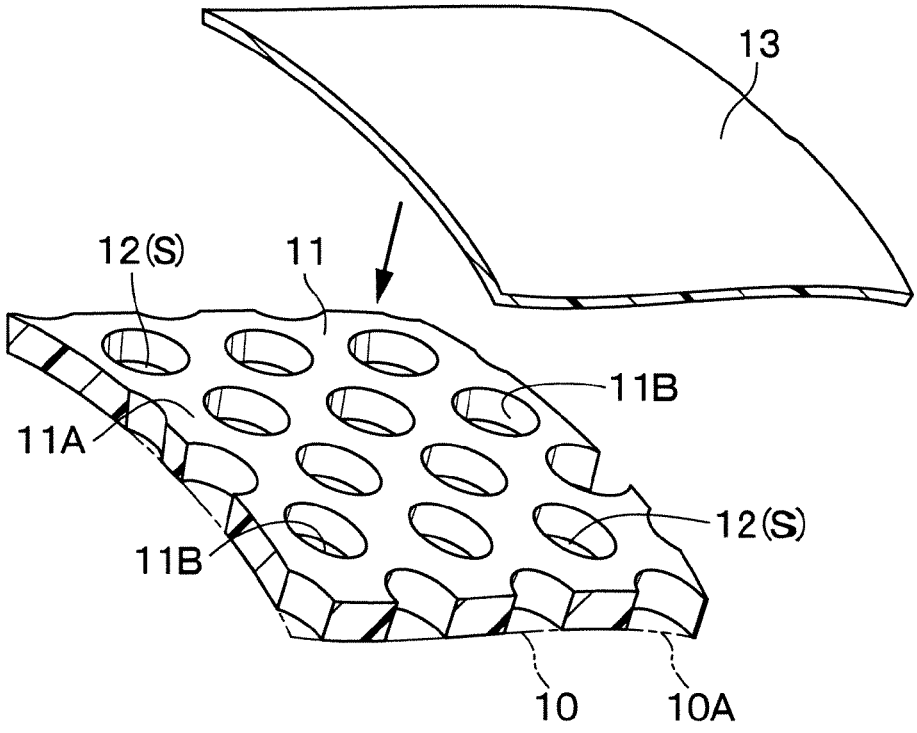
FIG. 4 is an exploded perspective view, showing an intermediate tube and a cover member of FIG. 3 in a disassembled or separated state.

Hereafter, the present invention is described more particularly with reference to the accompanying drawings which show rotary atomizing head type coating apparatus as embodiments of the electrostatic coating apparatus according to the present invention.

Referring first to FIGS. 1 through 7, there is shown a first embodiment of the present invention. In these figures, indicated at 1 is an atomizer as paint atomizing means for atomizing and spraying paint toward a work piece (not shown) which is held at the earth potential. This atomizer 1 is constituted by an air motor 2 and a rotary atomizing head 3, which will be described hereinafter.

Indicated at 2 is an air motor which is formed of a conducting metallic material. This air motor 2 is constituted by a motor housing 2A, a rotational shaft 2C which is hollow and rotatably supported within the motor housing 2A through air bearing 2B, and an air turbine 2D which is fixedly provided on a base end portion of the rotational shaft 2C. Upon supplying drive air to the air turbine 2D, the rotational shaft 2C of the air motor 2 is put in high speed rotation, for example, rotated at a speed of 3,000 to 100,000 r.p.m. together with the rotary atomizing head 3.

Denoted at 3 is a rotary atomizing head which is mounted on a fore end portion of the rotational shaft 2C of the air motor 2. This rotary atomizing head 3 is formed of, for example, a metallic material or a conducting synthetic resin material. While putting the rotary atomizing head 3 in high speed rotation by the air motor 2, paint is supplied thereto through a feed tube 4 which will be described later on, whereupon supplied paint is sprayed from releasing edges 3A at the fore end of the rotary atomizing head 3 under the influence of centrifugal force. Further, the rotary atomizing head 3 is connected to a high voltage generator 7, which will be described later on, through the air motor 2. Therefore, during an electrostatic coating operation, a high voltage is applied to the rotary atomizing head 3 as a whole, and a high voltage is directly charged to a paint flowing on surfaces of the rotary atomizing head 3.

Designated at 4 is a feed tube which is passed through the rotational shaft 2C. Fore end of the feed tube 4 is projected out of the fore end of the rotational shaft 2C and extended into the rotary atomizing head 3. A paint passage 5 which is provided internally of the feed tube 4 is connected to a paint supply source and a thinner supply source (both not shown) through a color changing valve device. A valve seat 4A is provided at a longitudinally intermediate portion of the feed tube 4 for seating and unseating a valve body 6A. Thus, the feed tube 4 is used to supply a paint from the paint supply source to the rotary atomizing head 3 through the paint passage 5 during a coating operation, and to supply a wash fluid (thinner, air and so forth) from the thinner supply source at the time of a cleaning operation or at the time of color change.

In place of the feed tube 4 adopted in the present embodiment, there may be employed a feed tube of a double tube construction which has a paint passage internally of an inner tube and a thinner passage internally of an outer tube. Further, instead of providing the paint passage 5 internally of the feed tube 4 as in the present embodiment, there may be employed a paint passage of a different shape or of different routing depending upon the type of the atomizer 1.

Indicated at 6 is a paint supply valve, for example, a normally closed paint supply valve, which is provided within the length of the paint passage 5. This paint supply valve 6 is constituted by a valve body 6A which is extended internally of the paint passage 5 and provided with a fore end portion to be seated on and unseated from the valve seat 4A, a piston 6C which is provided at the base end of the valve body 6A and fitted in a cylinder 6B, a valve spring 6D which is provided within the cylinder 6B to bias the valve body 6A in a closing direction, and a pressure receiving chamber 6E which is provided in the cylinder 6B on the opposite side of the valve spring 6D. When drive air (a pilot air) is introduced into the pressure receiving chamber 6E of the paint supply valve 6, the valve body 6A is moved in an opening direction against the action of the valve spring 6D to permit a paint flow through the paint passage 5.

Indicated at 7 is a high voltage generator which is connected to the air motor 2 to serve as a high voltage application means. This high voltage generator 7 is constituted by a multi-stage rectification circuit (the so-called Cockcroft circuit) which is constituted by a plurality of capacitors and diodes (both not shown). By the high voltage generator 7, a DC source voltage which is supplied from a high voltage controller 8 is elevated to generate a high voltage, for example, a high voltage in the range of −30 to −150 kV. At this time, a high voltage to be generated by the high voltage generator 7 is determined by the source voltage supplied from the high voltage controller 8. That is to say, the output voltage (a high voltage) of the high voltage generator 7 is controlled by the high voltage controller 8. Through a high voltage cable 7A, the high voltage generator 7 is connected to the air motor 2 and the rotary atomizing head 3 for directly charging paint with a high voltage by the rotary atomizing head 3.

Denoted at 9 is a housing member which is adapted to accommodate the air motor 2 and high voltage generator 7. This housing member 9 is composed of a main housing body 10, and an intermediate tube 11 which is fitted around the outer periphery of the main housing body 10. The housing member 9 is formed substantially in a cylindrical shape by the use of an electrically insulating synthetic resin material, for example, such as POM (polyoxymethylene), PET (polyethylene terephthalate), PEN (polyethylene naphthalate), PP (polypropylene), HP-PE (high-pressure polyethylene), HP-PVC (high-pressure polyvinylchloride), PEI (polyether imide), PES (polyether sulfon), polymethyl pentene and the like.

Indicated at 10 is a main housing body which constitutes part of the housing member 9. The main housing body 10 is formed substantially in a cylindrical shape, and an outer surface 10A of the main housing body 10 is formed of a cylindrical shape. The main housing body 10 serves to hold the air motor 2 of the atomizer 1, and, for example, is formed of Derlin (a trademark) which is inexpensive and excellent in workability. Formed into the front end of the main housing body 10 is a motor receptacle hole 10B which is adapted to accommodate the air motor 2 and the paint supply valve 6 therein. Further, formed into the rear end of the main housing body 10 is a generator receptacle hole 10C which is adapted to accommodate the high voltage generator 7 therein.

Indicated at 11 is an intermediate tube which is fitted around the outer periphery of the main housing body 10 (on the side of the outer surface 10A). This intermediate tube 11 is interposed between the main housing body 10 and a cover member 13 which will be described hereinafter. For the sake of mechanical strength, the intermediate tube 11 is formed, for example, in a thickness of 1 mm-3 mm. In this instance, the intermediate tube 11 is formed of one of electrically insulating synthetic resin materials POM, PET, PEN and PP mentioned hereinbefore. For example, the specific permittivity of the intermediate tube 11 is 3.7 in the case of POM, 2.9-3.2 in the case of PET, 2.9 in the case of PEN, and 2.2-2.6 in the case of PP.

Further, the intermediate tube 11 may be formed of other electrically insulating materials with a relatively high specific permittivity like alumina epoxy, zirconia and barium titanate. For example, the specific permittivity of the intermediate tube 11 is 5.5-8.5 in the case of alumina epoxy, 25-46 in the case of zirconia and 1200 in the case of barium titanate. In these cases, electric field strengthening effects are conspicuous as described in greater detail hereinafter.

In this instance, a large number of circular through holes 11B are provided in the intermediate tube 11, over the entire area of the outer surface 11A. These through holes 11B are closed by the outer surface 10A when the intermediate tube 11 is fitted on the outer surface 10A of the main housing body 10, and forms hollow cavities 12 which will be described hereinafter.

Denoted at 12 are a multitude of hollow cavities which are indented from the outer surface 11A of the intermediate tube 11. These hollow cavities 12 are formed by the through holes 11B and the outer surface 10A of the main housing body 10 when the intermediate tube 11 is fitted on the outer surface 10A of the main housing body 10. In this instance, the respective hollow cavities 12 are formed independently of each other, and equidistantly distributed over the entire areas of the outer surface 11A of the intermediate tube 11. Open ends on the rear side (on the inner side) of the hollow cavities 12 are closed by the outer surface 10A of the main housing body 10, while the open ends on the outer side of the hollow cavities 12 are closed by a cover member 13 which will be described hereinafter.

Indicated at 13 is a cover member which is formed in a tubular shape to enshroud the outer surface 11A of the intermediate tube 11. This cover member 13 is formed of a high electrically insulating and non-water-absorptive synthetic resin material with a different specific permittivity from the intermediate tube 11, for example, an electrically insulating synthetic resin material such as PTFE (polytetrafluoroethylene), POM (polyoxymethylene) or PET (polyethylene terephthalate) with surfaces treated with a water repellent agent. For example, the specific permittivity of the cover member 13 is approximately 2.1 in the case of PTFE, 3.7 in the case of POM and 2.9-3.2 in the case of PET.

The cover member 13 is in the form of a thin sheet, for example, with a thickness of 0.3 mm to 1 mm, and held in contact with the outer surface 11A of the intermediate tube 11. Accordingly, the cover member 13 closes the hollow cavities 12 from outside, providing circular closed spaces S thereunder. Further, the cover member 13 is provided with an annular front closing member 14 which is extended radially inward from the fore end of the cover member 13 in such a way as to close the front end of the housing member 9.

Indicated at 15 is a shaping air ring which spurts out shaping air. This shaping air ring 15 is attached to the front end (fore end side) of the cover member 13 through the front closing member 14, in such a way as to circumvent the outer periphery of the rotary atomizing head 3. Similarly to the cover member 13, the shaping air ring 15 is formed of a cylindrical shape by use of, for example, PTFE, POM or PET with surfaces treated with a water repellent agent. A multitude of air outlet holes 15A are bored in the shaping air ring 15, in communication with a shaping air passage 16 which is provided in the main housing body 10. Supplying shaping air through the shaping air passage 16, the air outlet holes 15A spurts out shaping air toward paint which are sprayed from the rotary atomizing head 3, for shaping the spray pattern of paint particles sprayed from the rotary atomizing head 3.

Being arranged in the manner as described above, the rotary atomizing head type coating apparatus of the present embodiment gives following performances in a coating operation.

As the rotary atomizing head 3 of the atomizer 1 is put in high speed rotation by the air motor 2, paint is supplied to the rotary atomizing head 3 through the feed tube 4. By the rotary atomizing head 3 of the atomizer 1 in high speed rotation, paint is atomized and sprayed in the form of finely divided particles under the influence of centrifugal force. At the same time, shaping air is supplied from the shaping air ring 15 to control the spray pattern of paint particles.

Concurrently, a high voltage is applied to the rotary atomizing head 3 from the high voltage generator 7 through the air motor 2. Therefore, paint which has been supplied to the rotary atomizing head 3 is imparted with a high voltage electrostatic charge directly through the rotary atomizing head 3. Charged paint particles are urged to fly toward and deposit on a work piece, traveling along an electrostatic field which is formed between the rotary atomizing head 3 and work piece.

In operation, the rotary atomizing head type coating apparatus of the first embodiment has the following effect in preventing deposition of charged paint particles on the coating apparatus itself.

In connection with this effect, distribution of electric field strength and distribution of equipotential lines around the rotary atomizing head type coating apparatus of the present embodiment are measured by three-dimensional simulation based on a finite-element method. The results are shown in FIGS. 5 to 7.

Exterior surfaces of the cover member 13 are charged with the same polarity and substantially at the same potential as the high voltage which is applied to the air motor 2. In this instance, the cover member 13 around the intermediate tube 11 closes the respective hollow cavities 12 from outside, defining closed spaces S. That is, the cover member 13 is held in contact with the outer surface 11A of the intermediate tube 11 except the hollow cavities 12. Since generally air is lower in specific permittivity as compared with the insulating material, the specific permittivity in the hollow cavities 12 (in the closed spaces S) differs, for example, 2 to 4 times as compared with contacting portions of the intermediate tube 11 which are held in contact with the cover member 13 and the outer surface 10A of the main housing body 10.

Figure 7:
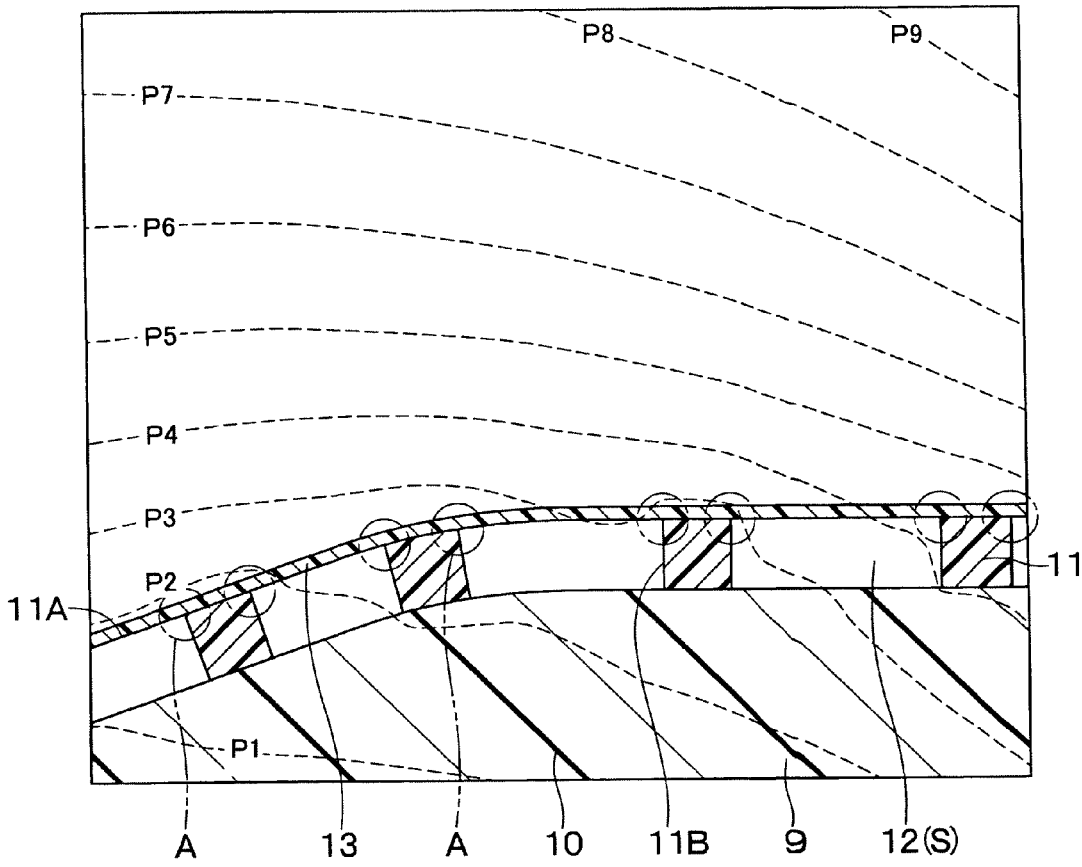
FIG. 7 is a schematic view, showing on an enlarged scale distribution of equipotential lines, taken in the same position as FIG. 6.

Since a multitude of hollow cavities 12 are provided in the intermediate tube 11, as shown in FIG. 7, equipotential lines P1 to P9 are undulated in a wavy form around the intermediate tube 11 and cover member 13 by the presence of the closed spaces S in the hollow cavities 12. As a consequence, the intervals between the equipotential lines P1 to P9 get narrower at the inner periphery of the through holes 11B which define the hollow cavities 12, intensifying the electric field strength at the respective hollow cavities 12 and creating a pattern of electric field strength which is intensified periodically at the respective hollow cavities 12.

Figure 5:
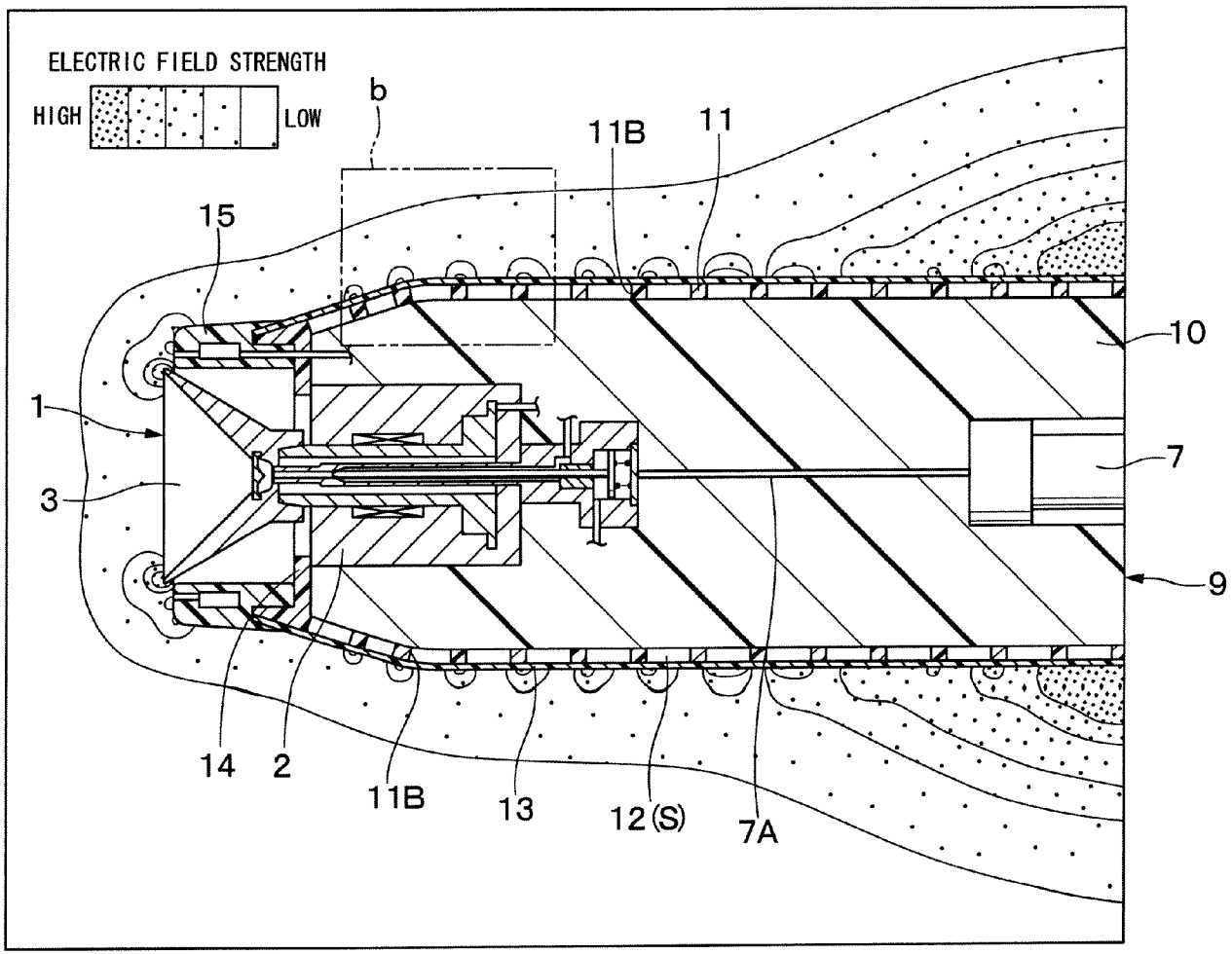
FIG. 5 is a schematic view, explanatory of distribution of electric field strength around the rotary atomizing head type coating apparatus of FIG. 1.
Figure 6:
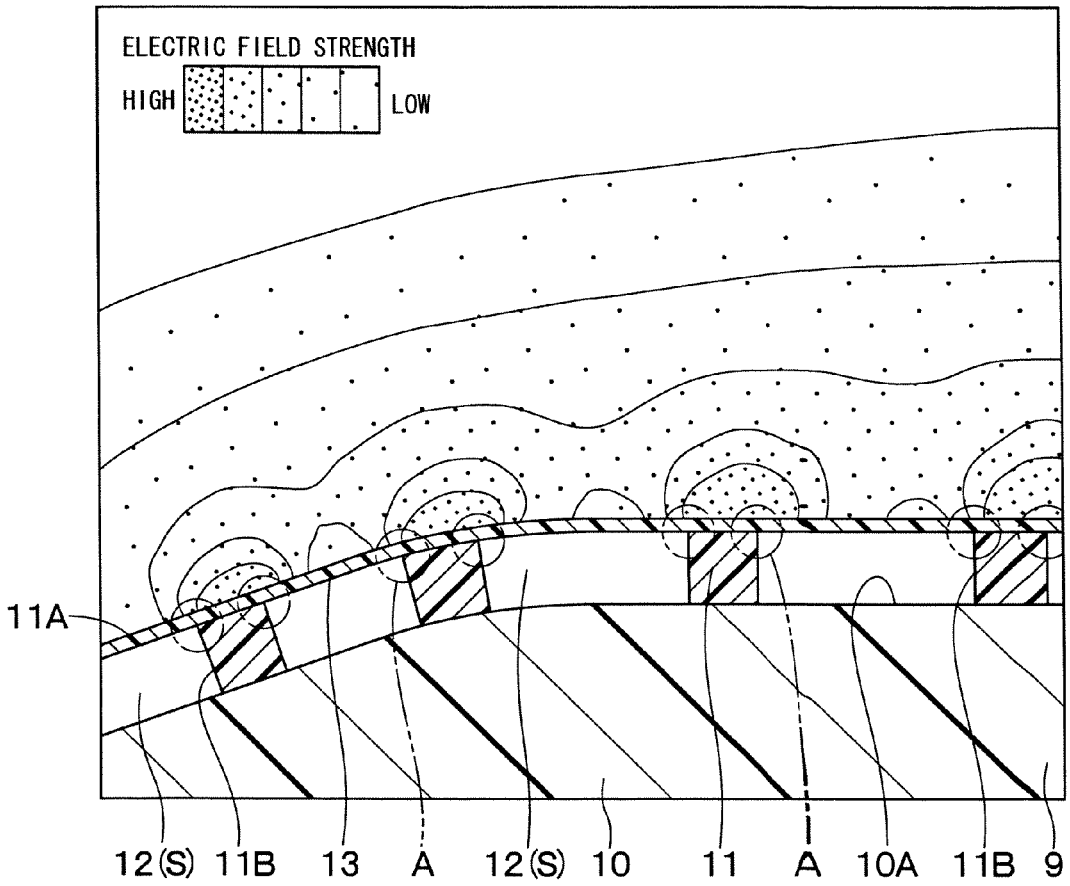
FIG. 6 is a schematic view, showing on an enlarged scale a demarcated area "b" of distribution of electric field strength in FIG. 5.

Consequently, as shown in FIGS. 5 and 6, the electric field strength is intensified periodically along the outer surface of the cover member 13. Therefore, the Coulomb repulsion force F (Eq. (1) below) which is proportional to the electric field strength can be enhanced to prevent deposition of charged paint particles effectively.

$$F=qE \tag{1}$$

Where q: electric charge possessed by paint particles

E: electric field strength

Especially, the first embodiment of the present invention is constituted by the closed spaces S within the hollow cavities 12, the intermediate tube 11 of the housing member 9 and the cover member 13, which differ from each other in specific permittivity. In this case, as indicated by a two-dot chain line in FIGS. 6 and 7, the equipotential lines P1 to P9, which are indicated by broken lines in FIG. 7, are distorted to a greater degree at outer end portions A of the hollow cavities 12 in the boundaries of the closed spaces S, intermediate tube 11 and cover member 13 which have different values in specific permittivity, intensifying the electric field strength furthermore.

Besides, in the first embodiment, the cover member 13 is in the form of a thin sheet having a thickness of 0.3 mm to 1 mm. Therefore, the boundary portions (the outer end portions A in FIG. 6) of the above-mentioned three members, i.e., the cover member 13, intermediate tube 11 and air layer which are different in specific permittivity, can be located as close as possible to the exterior surface of the cover member 13. Accordingly, by intensification of the electric field strength at the outer end portions A of the hollow cavities 12, the electric field strength on the exterior surface of the cover member 13 can also be intensified to effectively prevent deposition of charged paint particles on the cover member 13.

In case the housing member 9 is constructed in the prior art without providing hollow cavities 12, electrostatic charges on one member are constantly in movement for stabilization of the potential. Under the influence of constantly moving electrostatic charges, the electric field strength of the cover member 13 which is in contact with the housing member 9 becomes instable, resulting in non-uniform distribution of electric field strength over the entire cover member 13. That is to say, the cover member 13 comes to have weak spots and strong spots in electric field strength on its exterior surfaces, and charged paint particles floating in the ambient air tend to deposit on the weak spots in electric field strength in a concentrated fashion. Then, paint deposition is accelerated starting from the initially deposited spots.

In contrast, according to the first embodiment described above, the housing member 9 is provided with a plurality of hollow cavities 12 by the use of the through holes 11B of the intermediate tube 11. The cover member 13 can have a different fluctuation in potential at those portions which are in contact with the intermediate tube 11, as compared with other positions (non-contacting portions) which are located on the outer side of the hollow cavities 12 (closed spaces S). In this case, in the non-contacting portions of the cover member 13 which close the outer side of the hollow cavities 12, fluctuations in potential can take place freely within the respective boundaries, bringing about non-uniformity in electric field strength.

However, the above-mentioned fluctuations in potential are suppressed by the contacting portions of the cover member 13 which limit and confine fluctuations in potential to the non-contacting portions which cover the hollow cavities 12. A plurality of hollow cavities 12 are independently and uniformly distributed over the entire cover member 13, so that the electric field strength is balanced for the cover member 13 as a whole. That is to say, deposition of charged paint particles is prevented on the entire exterior surfaces of the cover member 13.

Thus, according to the first embodiment, hollow cavities 12 are provided on the outer surface of the housing member 9, and the cover member 13 is provided in contact with the outer surface of the housing member 9, intensifying the electric field strength of the cover member 13 in the vicinity of the hollow cavities 12 and as a result enhancing the Coulomb repulsion force to prevent deposition of charged paint particles on the cover member 13.

Further, a plurality of hollow cavities 12 are provided independently and uniformly over the entire outer surface of the housing member 9, keeping the electric field strength in a balanced state on the entire cover member 13 which encloses the hollow cavities 12. Accordingly, sporadic variations in electric field strength can be suppressed with respect to the cover member 13 as a whole, getting rid of local weak spots which are dipped in electric field strength. That is to say, deposition starting points no longer exist on the cover member 13, and deposition of paint particles can be prevented in a controlled manner.

Further, according to the present embodiment, the housing member 9 is composed of the main housing body 10 and the intermediate tube 11, and the hollow cavities 12 are provided by the use of the through holes 11B in the intermediate tube 11 which is in contact with the cover member 13. Accordingly, the hollow cavities 12 can be formed simply by opening the through holes 11B in the intermediate tube 11.

The main housing body 10, which accommodate the air motor 2, needs to be formed of an electrically insulating material which has excellent properties in workability. In contrast, irrespective of the main housing body 10, the intermediate tube 11 can be formed of almost any arbitrary material. Accordingly, an electrically insulating material with a high specific permittivity can be used for the intermediate tube 11, for the purpose of magnifying distortions of the equipotential lines P1 to P9 at outer end portions of the hollow cavities 12 to intensify the electric field, preventing deposition of charged paint particles in a more assured manner.

Furthermore, since the air motor 2 is accommodated in the housing member 9, the cover member 13 is located in such a position as to enshroud the housing member 9 and circumvent the air motor 2. In this case, the high voltage generator 7 is adapted to apply a high voltage to the air motor 2. Therefore, by the air motor 2, exterior surfaces of the cover member 13 which circumvents the air motor 2 can be electrified with a high voltage electrostatic charge in a stabilized state, preventing deposition of paint particles on the cover member 13.

Figure 8:
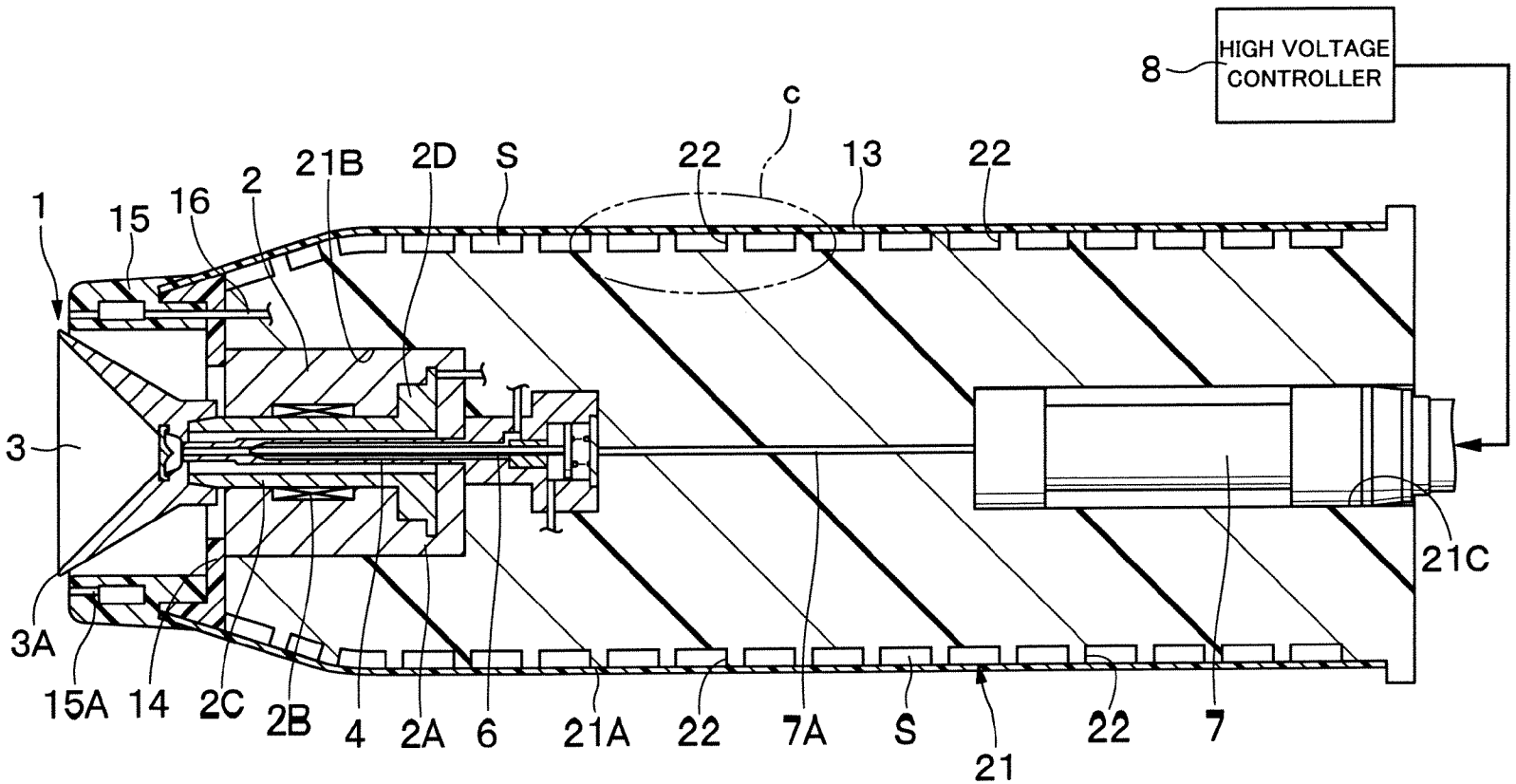
FIG. 8 is a longitudinal sectional view of a rotary atomizing head type coating apparatus according to a second embodiment of the present invention.
Figure 9:
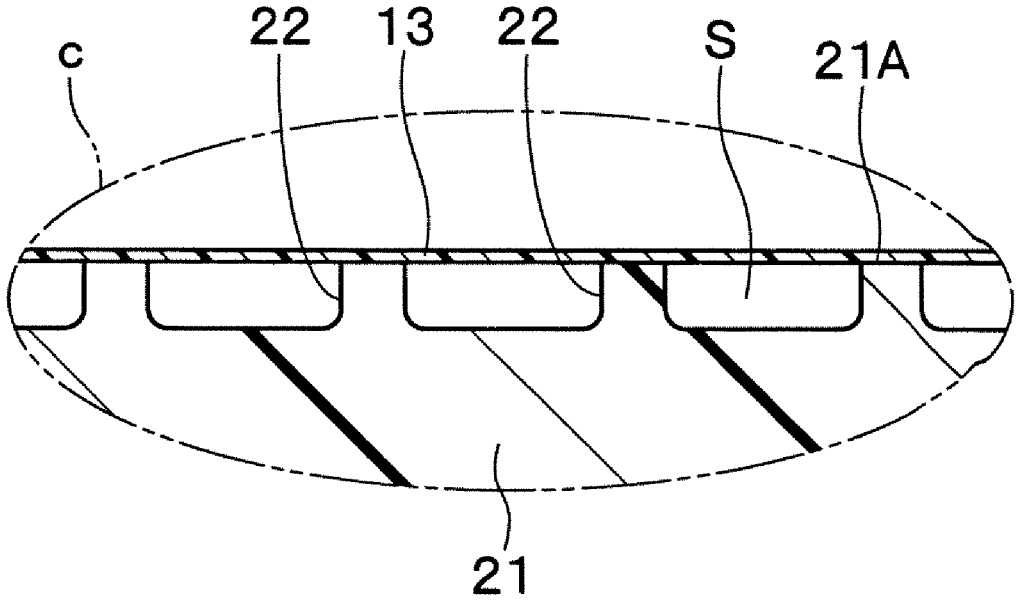
FIG. 9 is a fragmentary longitudinal section, showing on an enlarged scale a demarcated area "c" in FIG. 8.

Now, turning to FIGS. 8 and 9, there is shown a rotary atomizing head type coating apparatus according to a second embodiment of the present invention. The second embodiment has features in that the housing member is constituted by a singular structure and provided with a plurality of hollow cavities which have bottoms on its circumferential surface. In the following description of the second embodiment, those component parts which are identical with the counterparts in the foregoing first embodiment are simply designated by the same reference numerals or characters to avoid repetitions of same explanations.

Indicated at 21 is a housing member adopted in the second embodiment. Substantially in the same manner as the housing member 9 in the first embodiment, this housing member 21 is adapted to accommodate an atomizer 1 and a high voltage generator 7 and generally formed in a cylindrical shape by the use of an electrically insulating synthetic resin material. A cover member 13 is fitted on the housing member 21 in contact with outer surface 21A of the latter. Formed into the front end of the housing member 21 is a motor receptacle hole 21B which is adapted to accommodate an air motor 2, and formed into the rear end of the housing member 21 is a generator receptacle hole 21C which is adapted to accommodate a high voltage generator 7.

Indicated at 22 are a plurality of hollow cavities which are formed in the circumferential surface of the housing member 21. Similarly to the hollow cavities 12 in the first embodiment, these hollow cavities 22 are recessed inward of the outer surface 21A of the housing member 21. Further, the respective hollow cavities 22 are formed independently of each other and distributed uniformly over the entire outer surface 21A of the housing member 21. In this instance, for example, each one of the hollow cavities 22 is a bottomed hole of a circular shape provided in the outer surface 21A of the housing member 21. Outer open ends of the hollow cavities 22 are closed with the cover member 13 to define a closed space S in each hollow cavity 22.

Thus, the second embodiment can produce substantially the same operational effects as the foregoing first embodiment. Especially in the case of the second embodiment, the housing member 21 is constituted by a singular structure, so that it does not require an assembling work, contributing to cut the production Cost.

Figure 10:
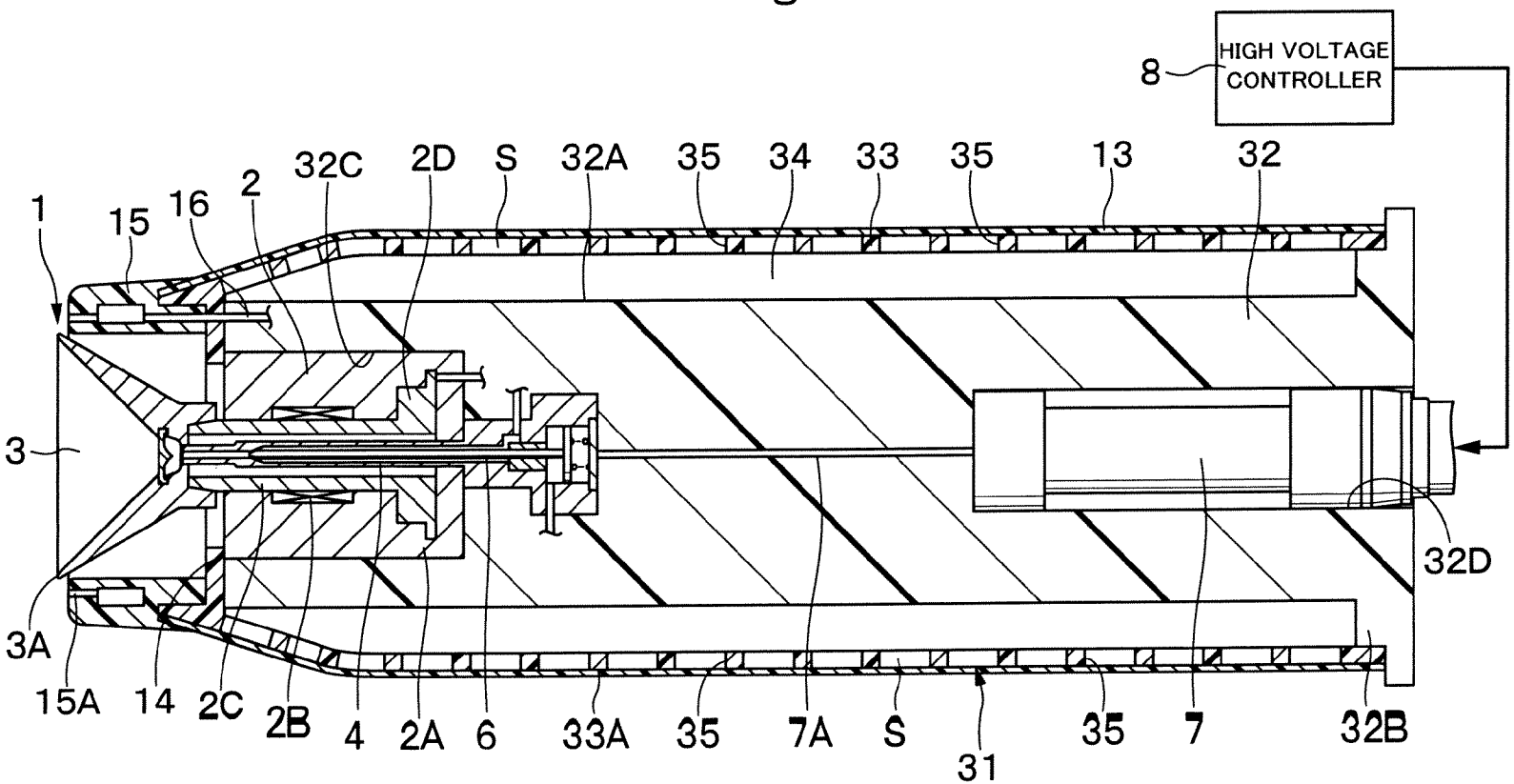
FIG. 10 is a longitudinal sectional view of a rotary atomizing head type coating apparatus according to a third embodiment of the present invention.

Now, turning to FIG. 10, there is shown a rotary atomizing head type coating apparatus according to a third embodiment of the present invention. This third embodiment has a feature in that a space is interposed between entire opposing surfaces of a main housing body and an intermediate tube. In the following description of the third embodiment, those component parts which are identical with the counterparts in the foregoing first embodiment are simply designated by the same reference numerals or characters to avoid repetitions of same explanations.

Indicated at 31 is a housing member adopted in the third embodiment. Substantially in the same manner as the housing member 9 in the first embodiment, this housing member 31 is formed substantially in a cylindrical shape by the use of an electrically insulating synthetic resin material. The housing member 31 is composed of amain housing body 32 and an intermediate tube 33 which is provided around the circumference of the main housing body 32, as will be described in greater detail hereinafter.

Designated at 32 is a main housing body which is adapted to accommodate an air motor 2 of an atomizer 1 and a high voltage generator 7. Substantially in the same manner as the main housing body 10 in the first embodiment, this main housing body 32 is formed substantially in a cylindrical shape by the use of an electrically insulating synthetic resin material. However, as compared with the main housing body 10 in the first embodiment, the main housing body 32 is formed in a smaller diameter. The main housing body 32 is provided with a cylindrical outer surface 32A, and formed with a flanged wall of a larger diameter at its rear end 32B.

Further, a motor receptacle hole 32C is formed axially into the fore end of the main housing body 32 to accommodate an air motor 2 therein, while a generator receptacle hole 32D is formed axially into the rear end to accommodate a high voltage generator 7 therein. However, as mentioned above, the main housing body 32 is formed in a smaller diameter as compared with the main housing body 10 of the first embodiment.

Indicated at 33 is an intermediate tube which is formed of an electrically insulating synthetic resin material and located in such a way as to circumvent the outer surface 32A of the main housing body 32, leaving a gap space therearound. Substantially in the same manner as the intermediate tube 11 in the first embodiment, this intermediate tube 33 is formed in the shape of a tube, for example, with a wall thickness of 1 mm to 3 mm. A cover member 13 is fitted on the outer surface 33A of the intermediate tube 33 in contact with the latter.

In this instance, rear end of the intermediate tube 33 is fixedly fitted on a larger diameter rear end 32B of the main housing body 32, while fore end of the intermediate tube 33 is fixedly fitted on a front closing member 14. The portion which the intermediate tube 33 and the outer surface 32A of the main housing body 32 are radially confronted (axial directional intermediate portion of the intermediate tube 33) is radially spaced from the main housing body 32 as a substantially entire area. As a result, an annular gap space 34 having redially lateral section is formed between the intermediate tube 33 and the main housing body 32.

Indicated at 35 are a plurality of hollow cavities which are indented radially inward of the outer surface 33A of the intermediate tube 33. These hollow cavities 35 are formed independently of each other and uniformly distributed over the entire outer surface 33A of the intermediate tube 33. In this instance, the hollow cavities 35 are, for example, in the form of circular through holes which are opened through the inner and outer surfaces of the intermediate tube 33, and a closed space S is provided in each one of these hollow cavities 35. The respective outer open ends of the hollow cavities 35 are closed with the cover member 13, but are opened to the annular gap space 34 on the inner or back side.

Thus, the third embodiment can produce substantially the same operational effects as the foregoing first embodiment. Especially in the case of the third embodiment, the annular gap space 34 is provided between the main housing body 32 and the intermediate tube 33, along entire confronting surfaces of the main housing body 32 and the intermediate tube 33 for keeping the main housing body 32 which is lower in resistance compared with air from contacting the intermediate tube 33 as much as possible, in other words, for reducing contacting portions of the main housing body 32 to a minimum. Accordingly, in this case, the cover member 13 can be kept in a charged state to prevent deposition of charged paint particles, by reducing leakage of charges of high voltage on the exterior surfaces of the cover member 13 through the intermediate tube 33 and the main housing body 32.

Figure 11:
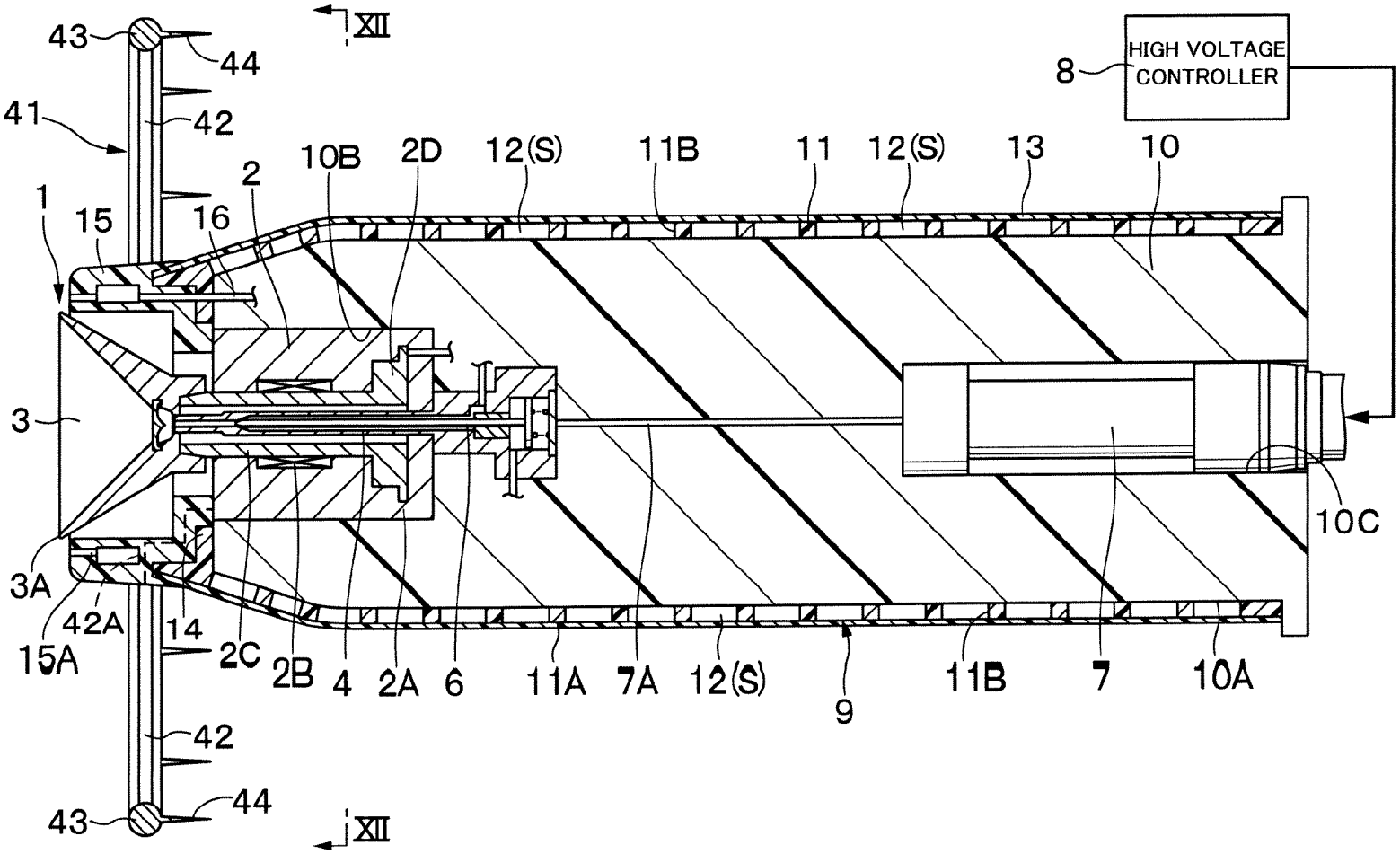
FIG. 11 is a longitudinal sectional view of a rotary atomizing head type coating apparatus according to a fourth embodiment of the present invention.
Figure 12:
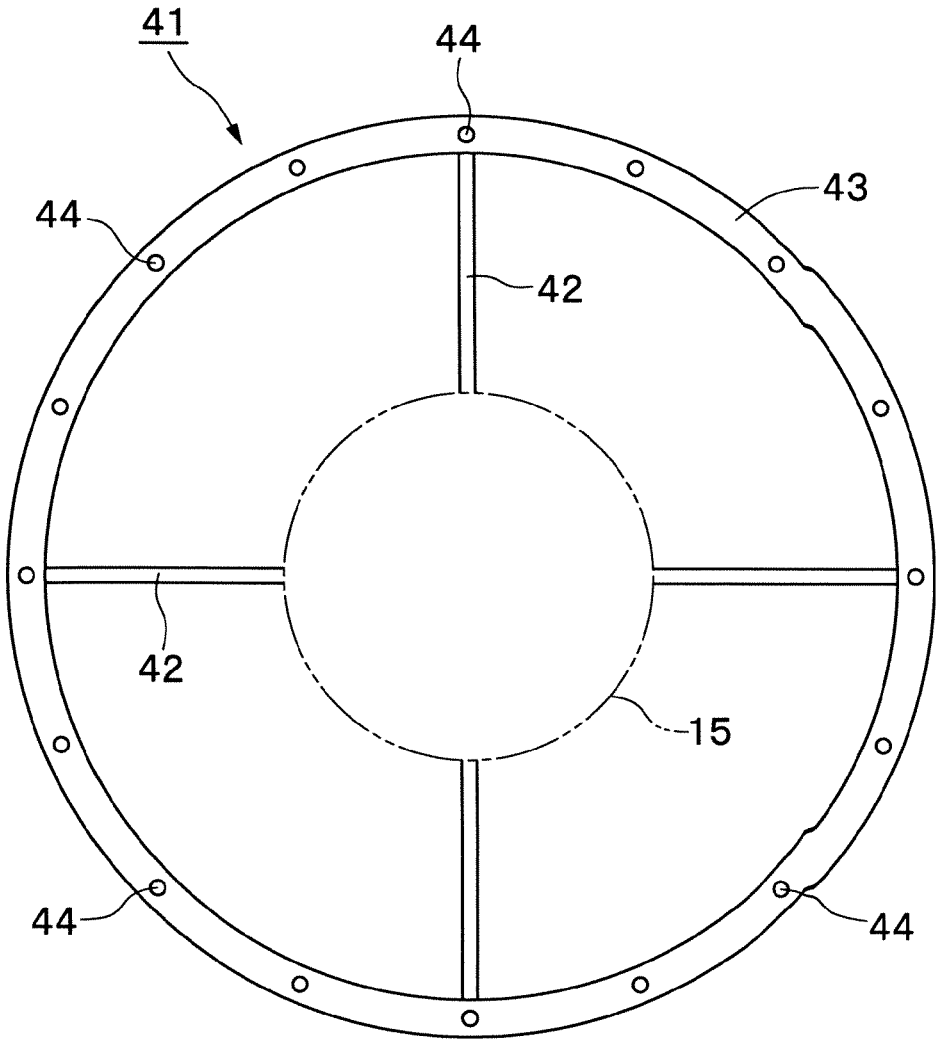
FIG. 12 is a right-hand side view of a high voltage discharge electrode assembly in the fourth embodiment, taken from the direction of arrows XII-XII of FIG. 11.

Now, turning to FIGS. 11 and 12, there is shown a rotary atomizing head type coating apparatus according to a fourth embodiment of the present invention. The fourth embodiment has a feature in that a high voltage discharge electrode assembly is provided on an outer peripheral side of a cover member. In the following description of the fourth embodiment, those component parts which are identical with the counterparts in the foregoing first embodiment are simply designated by the same reference numerals or characters to avoid repetitions of same explanations.

Indicated at 41 is a high voltage discharge electrode assembly which is located on an outer peripheral side of a shaping air ring 15. The high voltage discharge electrode assembly 41 is constituted by radially extended support arms 42, a ring member 43 and electrode member 44, which will be described hereinafter.

Denoted at 42 are support arms which are extended radially outward from the shaping air ring 15. These support arms 42 are provided at uniform angular intervals around the shaping air ring 15. For example, in the particular embodiment shown, four support arms 42 are provided to support the ring member 43. The support arms 42 are formed of a conducting material and electrically connected to the air motor 2 through a connecting wire 42A.

Indicated at 43 is a ring member which is supported on outer ends of the support arms 42. This ring member 43 is formed in a circular shape by the use of a conducting material like a conducting metal, for example. The ring member 43 is positioned around the air motor 2 and attached in such a way as to circumvent the shaping air ring 15. More specifically, the ring member 43 is formed in a greater diameter as compared with the outside diameter of the shaping air ring 15, and positioned in coaxial relation with the rotational shaft 2C of the air motor 2. Accordingly, the ring member 43 is kept at a constant distance from the shaping air ring 15 at any angular position on its entire circular body. The ring member 43 is connected to the air motor 2 by way of connecting wire 42A and support arms 42. Consequently, from the high voltage generator 7, a high voltage is applied to the ring member 43 and electrode members 44.

Indicated at 44 are electrode members which are provided on the ring member 43. Each one of these electrode members 44 is in the form of an acicular electrode made of a conducting material like a conducting metal. The respective electrode members 44 on the ring member 43 are extended in a direction away from a work piece (in a rearward direction). Further, the electrode members 44 are located in uniformly spaced positions on the circular ring member 43. Relative to the axis of the air motor 2 (the rotational shaft 2C), each one of the electrode members 44 is extended in a parallel direction or with an angle of depression in the range of 10 degrees or an angle of elevation in the range of 20 degrees.

Thus, the above-described fourth embodiment can produce substantially the same operational effects as the foregoing first embodiment. Especially in the case of the fourth embodiment, the high voltage discharge electrode assembly 41 is provided on the radially outside of the shaping air ring 15, so that a high voltage from the high voltage generator 7 is applied to the ring member 43 by way of the air motor 2 and discharged from the electrode members 44.

Thus, by the use of the high voltage discharge electrode assembly 41, ions of the same polarity as charged paint particles are discharged to electrify the cover member 13 with electrostatic charges of the same polarity. Further, by the use of the high voltage discharge electrode assembly 41, a high voltage electrostatic field can be formed on the outer peripheral side of the cover member 13. Therefore, under the influence of the electrostatic field of the high voltage discharge electrode assembly 41, charged paint particles are prevented from approaching the cover member 13, and deposition of charged paint particles is prevented by the cover member 13 which is electrified with a high voltage.

Further, since the high voltage discharge electrode assembly 41 is constructed of the support arms 42, ring member 43 and electrode members 44, a high voltage electrostatic field is formed around the circumference of the cover member 13 by the ring member 43 circumventing the cover member 13, keeping charged paint particles off the cover member 13. On the other hand, a high voltage is discharged by the electrode members 44 which are extended in a direction away from a work piece, so that the cover member 13 can be electrified with a high voltage electrostatic charge up to its rear end. That is to say, deposition of charged paint particles can be prevented in broad areas of the cover member 13.

Figure 13:
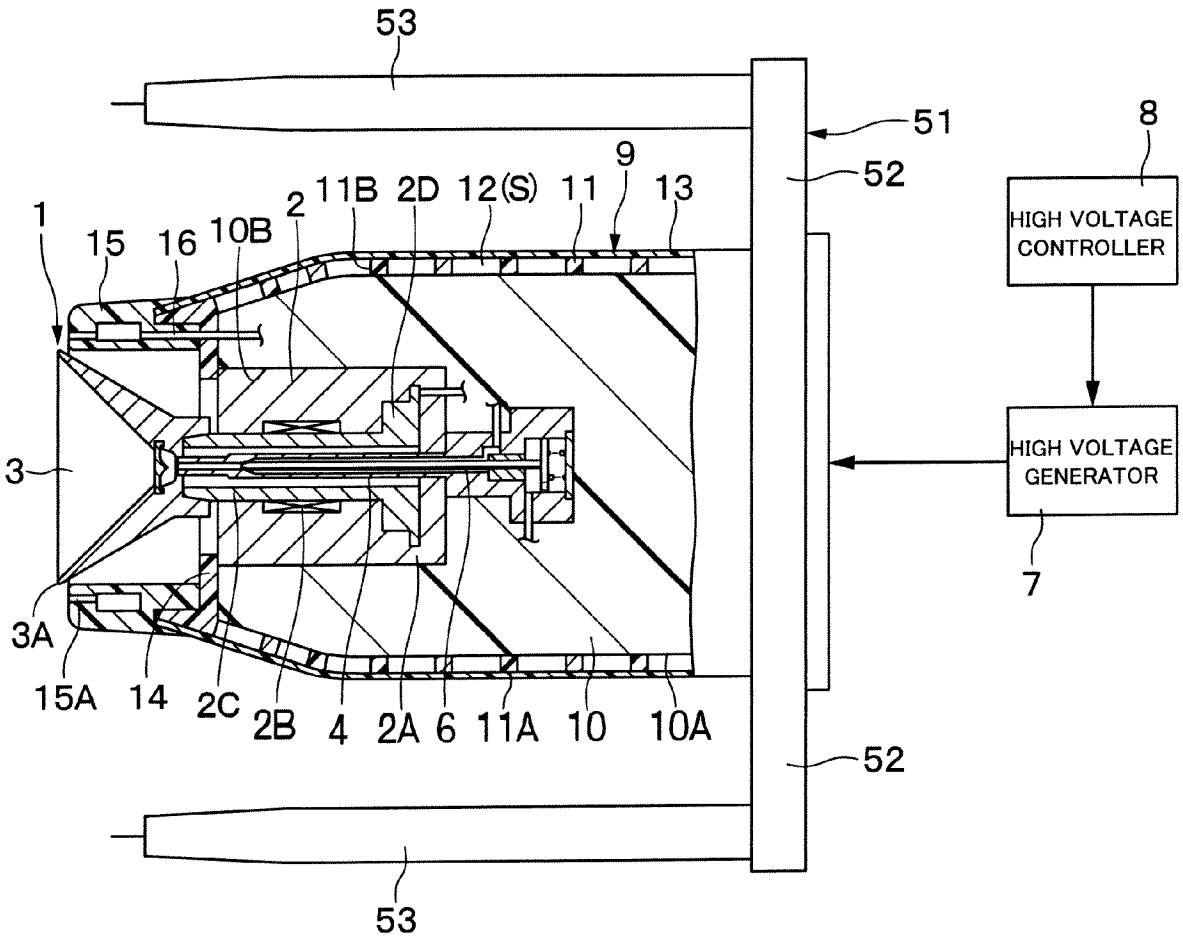
FIG. 13 is a longitudinal sectional view of a rotary atomizing head type coating apparatus according to a fifth embodiment of the present invention.

Turning now to FIG. 13, there is shown a rotary atomizing head type coating apparatus according to a fifth embodiment of the invention. This fifth embodiment has a feature in that a high voltage is applied to external electrode assembly which is located radially on the outer side of a cover member by a high voltage generator. In the following description of the fifth embodiment, those component parts which are identical with counterparts in the foregoing first embodiment are simply designated by the same reference numerals or characters to avoid repetitions of same explanations.

Indicated at 51 is an external electrode assembly which is located around the outer periphery of a cover member 13 and which is constituted by support arms 52 and acicular electrode members 53, which will be described hereinafter.

Indicated at 52 are a plural number of support arms which are provided in a rear side of the housing member 9. These support arms 52 are located radially relative to the rotational shaft 2C of the air motor 2, and extended radially outward of the housing member 9.

Denoted at 53 are acicular electrode members which are provided on outer distal ends of the support arms 52, the acicular electrode members 53 being extended forward on the front side of the respective support arms 52 and the distal ends of the acicular electrode member 53 is located around the rotary atomizing head 3. The acicular electrode members 53 are connected to a high voltage generator 7 through the support arms 52, and applied with a high voltage by the latter.

Thus, the fifth embodiment can produce substantially the same operational effects as the foregoing first embodiment. Especially in the case of the fifth embodiment, the high voltage generator 7 is adapted to apply a high voltage to the external electrode assembly 51 which is located radially on the outer side of the cover member 13. Therefore, an ionization zone is formed around the rotary atomizing head 3 by the external electrode assembly 51 thereby to indirectly charge paint particles which are sprayed from the rotary atomizing head 3. Besides, exterior surfaces of the cover member 13 are stably electrified with high voltage electrostatic charges by the external electrode assembly 51 which is applied with a high voltage, preventing deposition of charged paint particles on the cover member 13.

Figure 14:
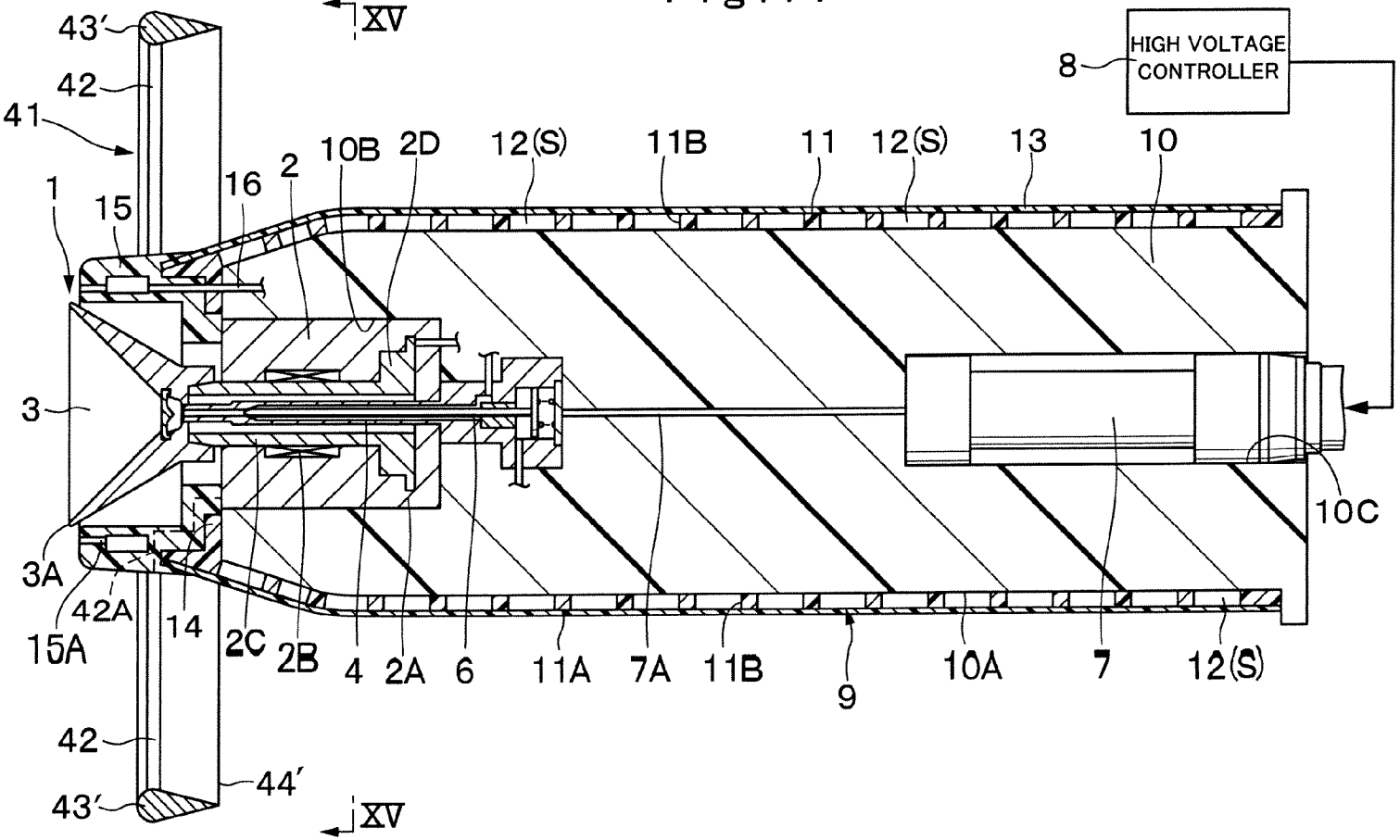
FIG. 14 is a longitudinal sectional view of a first modification of a rotary atomizing head type coating apparatus according to the present invention.
Figure 15:
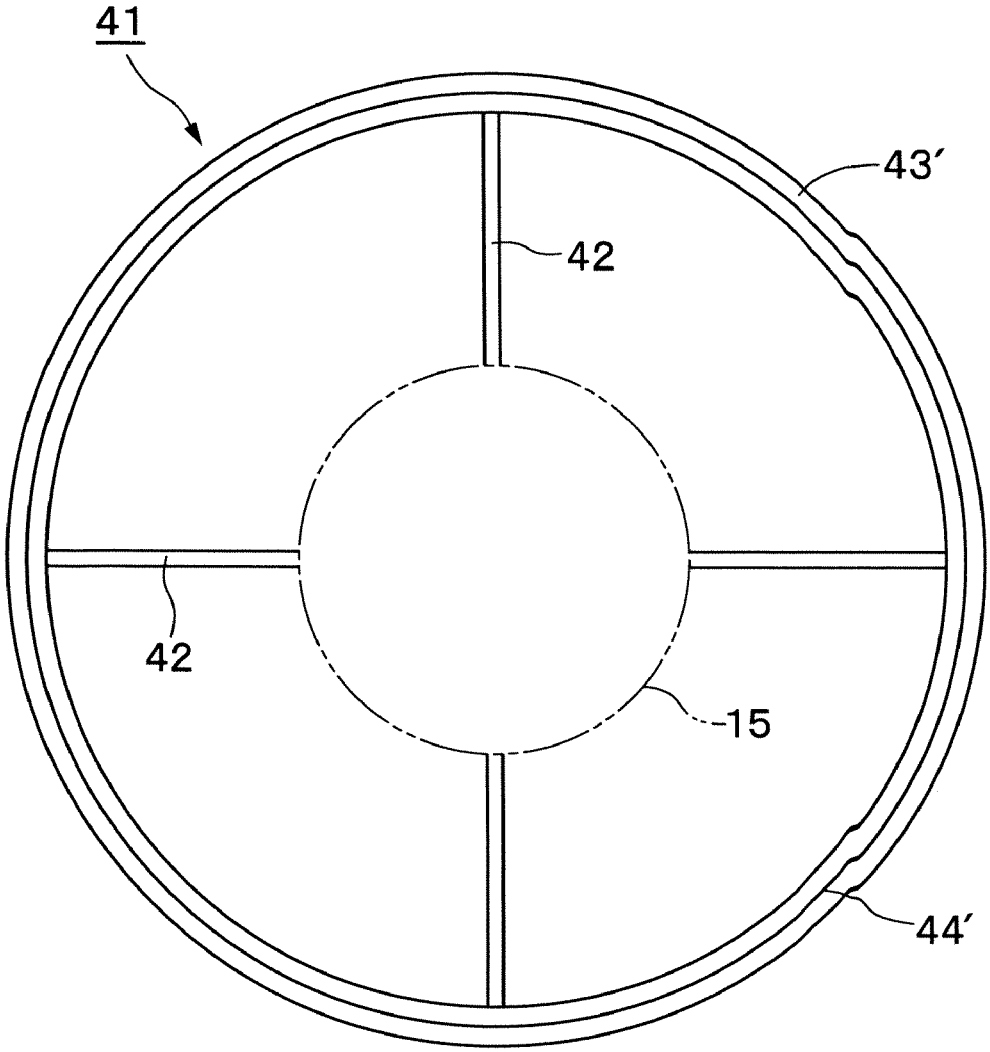
FIG. 15 is a right-hand side view of a high voltage discharge electrode assembly in the first modification, taken from the direction of arrows XV-XV of FIG. 14.

In the case of the fourth embodiment described above, a plural number of electrode members 44 of an acicular form are provided on the ring member 43. However, it is to be understood that the present invention is not limited to the particular arrangements shown. For example, there may be employed a discharge ring as in a first modification shown in FIGS. 14 and 15. Namely, the discharge ring of the first modification is constituted by a ring member 43' and a blade-like electrode portion 44' which is projected rearward of the ring member 43'. In this case, it suffices to bend a blade into a circular ring-like shape.

Further, in the fifth embodiment described above, the external electrode assembly 51 is applied to the rotary atomizing head type coating apparatus according to the first embodiment. However, the present invention is not limited to this particular example. Namely, the external electrode assembly can be similarly applied to rotary atomizing head type coating apparatus of the second to fourth embodiments.

Figure 16:
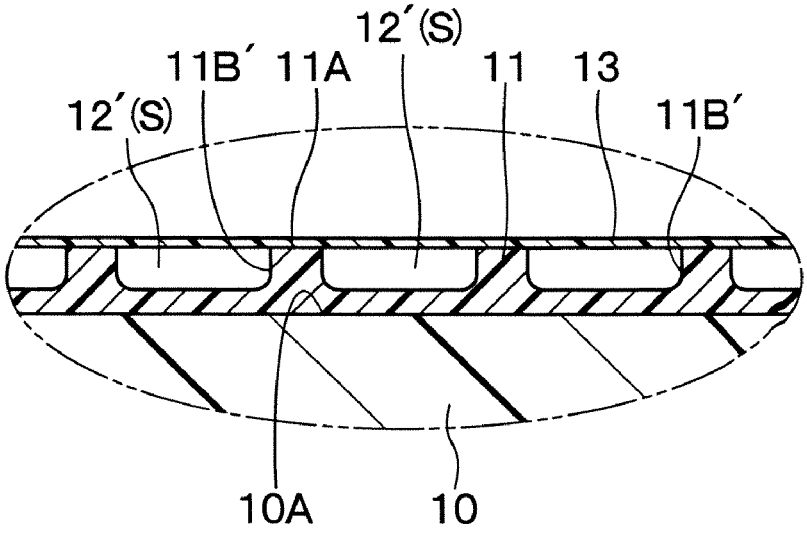
FIG. 16 is a fragmentary longitudinal section, showing on an enlarged scale a cover member and hollow cavities in a second modification, taken in the same position as FIG. 3.

Further, in the first, third, fourth and fifth embodiments, the hollow cavities 12 are formed by opening through holes 11B in the intermediate tube 11 of the housing member 9. However, in this regard, the present invention is not limited to this particular example. Namely, as in a second modification shown in FIG. 16, hollow cavities 12' may be formed by way of bottomed holes 11B' which are dug into an intermediate tube 11.

Figure 17:
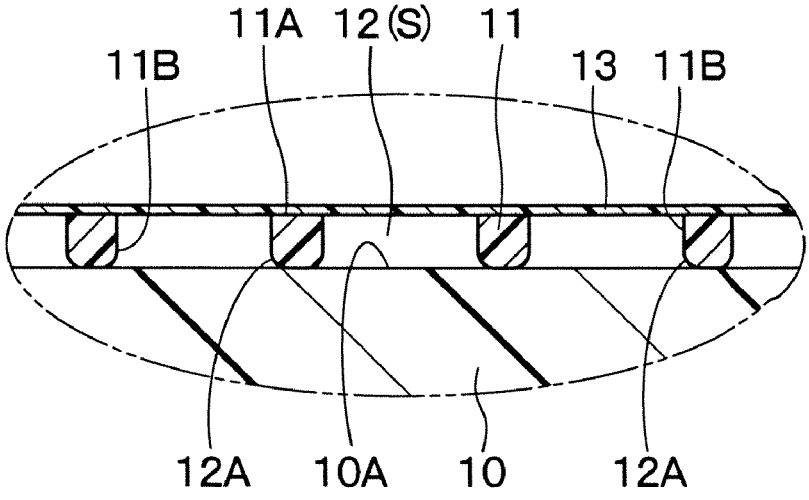
FIG. 17 is a fragmentary longitudinal section, showing on an enlarged scale a cover member and hollow cavities in a third modification, taken in the same position as FIG. 3.

Furthermore, in the first, third, fourth and fifth embodiments, the hollow cavities 12 are formed by providing through holes 11B which are approximately uniform in diameter in the intermediate tube 11 of the housing member 9. However, the present invention is not limited to this particular example. For instance, as in a third modification shown in FIG. 17, a chamfered portion 12A may be provided around an opening on the inner or rear side of each hollow cavity 12.

Further, in the foregoing embodiments, the shaping air ring 15 is described as being formed of an electrically insulating synthetic resin material. However, the present invention is not limited to a shaping air ring of this sort. For instance, there may be employed a shaping air ring of conducting metallic material. In such a case, a high voltage of the same polarity as charged paint particle is applied to the shaping air ring of conducting metallic material through the air motor, so that the shaping air ring functions as a repulsive electrode to prevent deposition of charged paint particles on the shaping air ring.

Figure 18:
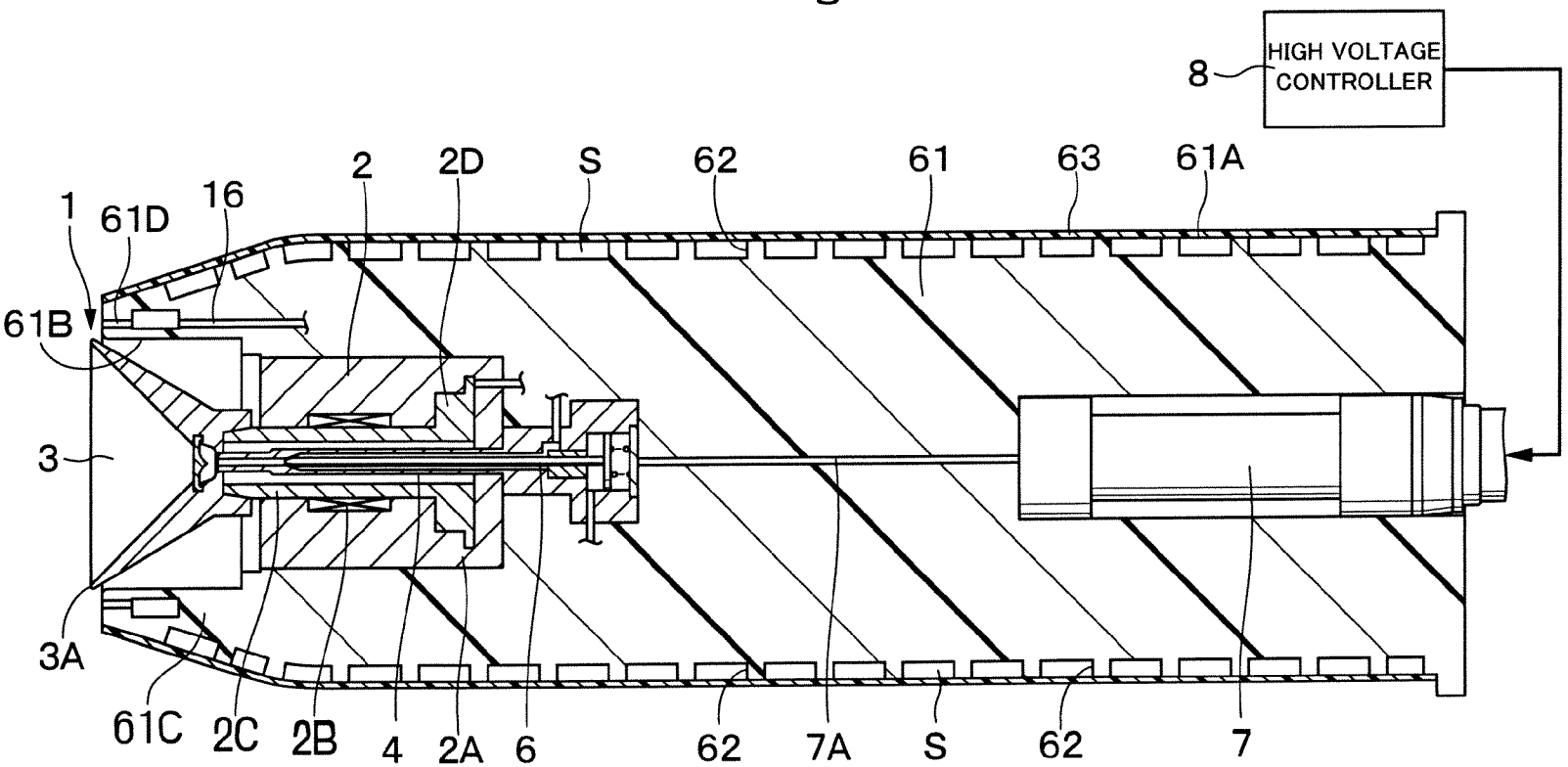
FIG. 18 is a longitudinal sectional view of a rotary atomizing head type coating apparatus according to a fourth modification.

Moreover, in the first to fifth embodiment, the shaping air ring 15 and housing member 9 are provided as separate structures which are formed separately of each other, and hollow cavities 12, 22 or 35 which are formed in the entire outer surface 11A, 21A or 33A of the housing member 9, 21 or 31 are covered with the cover member 13. However, in this regard, the present invention is not limited to the particular example shown. For instance, the shaping air ring and housing member may be formed into one integral structure as in a fourth modification shown in FIG. 18.

More specifically, in this case, a shaping air ring is integrally formed at a fore end of a housing member 61, and hollow cavities 62 are formed in the entire outer surface 61A of the housing member 61 which is wrapped in a film-like cover member 63 of an electrically insulating synthetic resin material.

An atomizing head receiving hollow space 61B is provided at the fore end of the housing member 61 to accommodate a rotary atomizing head 3 therein, and a shaping air spout ring 61C is formed around the atomizing head receiving hollow space 61B. A plural number of air outlet holes 61D are provided on the shaping air spout ring 61C. Thus, the cover member 63 is arranged to cover the outer periphery of the shaping air ring as well to prevent deposition of charged paint particles on the shaping air ring.

Figure 19:
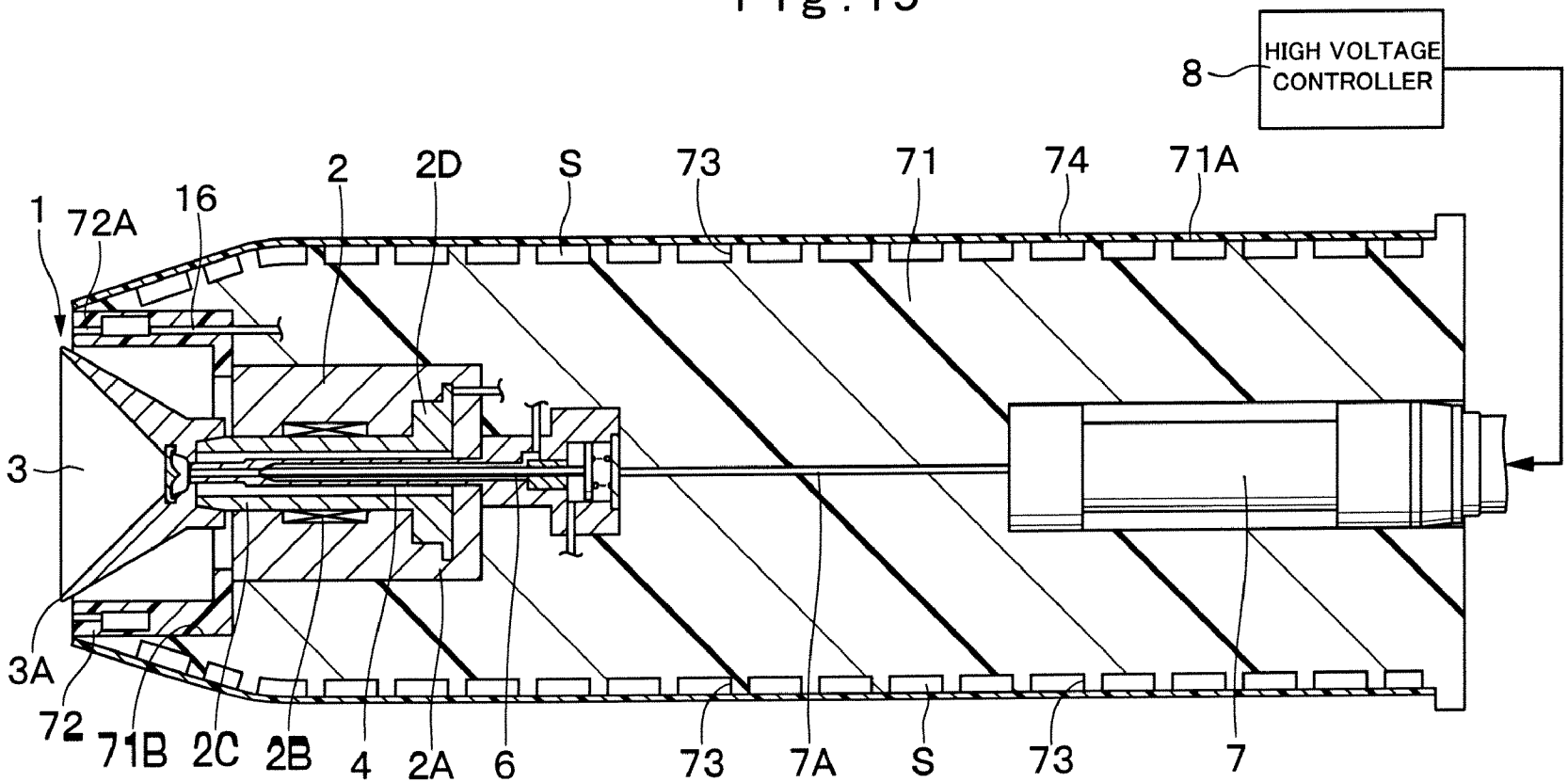
FIG. 19 is a longitudinal sectional view of a rotary atomizing head type coating apparatus according to a fifth modification.

Alternatively, the housing member may be constructed as in a fifth modification shown in FIG. 19. Namely, in the modification of FIG. 19, a shaping air ring 72 is accommodated inside of a front end portion of a housing member 71, and hollow cavities 73 are formed in the entire outer surface 71A of the housing member 71. The housing member 71 is covered with a film-like cover member 74 which is formed of an electrically insulating synthetic resin material.

In this case, a recess 71B is provided at the front end of the housing member 71 to accommodate the shaping air ring 72 which is provided with a plural number of air outlet holes 72A. This fifth modification has the same effects as the foregoing fourth modification in preventing deposition of charged paint particles on the shaping air ring 72 by the use of the cover member 74.

Furthermore, in the foregoing embodiments, as a typical example of electrostatic coating apparatus, the invention is applied to a rotary atomizing head type coating apparatus (rotary atomizing type electrostatic coating apparatus) which is adapted to atomize and spray paint particles by the use of a rotary atomizing head. However, it is to be understood that the present invention is not limited to an electrostatic coating apparatus of this sort, and can be similarly applied to other electrostatic coating apparatuses such as pneumatic atomization type electrostatic coating apparatuses and hydraulic atomization type electrostatic coating apparatuses.

The invention claimed is:

1. An electrostatic coating apparatus comprising:

a paint atomizing means for spraying atomized paint particles toward a work piece;

a housing member formed of an electrically insulating material that enshrouds said paint atomizing means;

a tubular cover member that enshrouds outer surfaces of said housing member, the tubular cover member being separate from the housing member; and a high voltage application means for imparting a high voltage electrostatic charge to paint particles to deposit charged paint particles sprayed from said paint atomizing means on surfaces of said work piece, wherein a plurality of hollow cavities are formed in and sunken from outer surfaces of said housing member; and an inner surface of said cover member is in contact with and enshrouds the plurality of hollow cavities and the outer surfaces of said housing member and closes outer sides of said hollow cavities, defining a closed space in each one of said hollow cavities.

2. An electrostatic coating apparatus as defined in claim 1, wherein a high voltage discharge electrode assembly is provided around an outer periphery of said cover member to discharge a high voltage of a same polarity as said charged paint particles.

3. An electrostatic coating apparatus as defined in claim 1, wherein said paint atomizing means includes a means for pressurizing air accommodated in said housing member, and a rotary atomizing means for rotary spraying and atomizing paint, the rotary atomizing means for rotary spraying and atomizing paint being rotatably supported on the means for pressurizing air.

4. An electrostatic coating apparatus as defined in claim 3, wherein said high voltage application means includes a means for applying a high voltage to said means for pressurizing air and said rotary atomizing means for rotary spraying and atomizing paint to directly apply the high voltage to paint being supplied to said rotary atomizing means for rotary spraying and atomizing paint.

5. An electrostatic coating apparatus as defined in claim 3, wherein said high voltage application means includes a means for applying a high voltage to an external electrode assembly located radially on an outer side of said cover member to indirectly charge paint particles with the high voltage when said rotary atomizing means for rotary spraying and atomizing paint sprays the paint particles.

6. An electrostatic coating apparatus comprising:

a paint atomizing unit that sprays atomized paint particles toward a work piece;

a housing member formed of an electrically insulating material that enshrouds said paint atomizing unit;

a tubular cover member that enshrouds outer surfaces of said housing member, the tubular cover member being separate from the housing member; and a high voltage application unit that imparts a high voltage electrostatic charge to paint particles to deposit charged paint particles sprayed from said paint atomizing unit on surfaces of said work piece, wherein a plurality of hollow cavities are formed in and sunken from outer surfaces of said housing member, an inner surface of said cover member is in contact with and enshrouds the plurality of hollow cavities and the outer surfaces of said housing member and closes outer sides of said hollow cavities, defining a closed space in each one of said hollow cavities, said housing member is comprised of a main housing body that holds said paint atomizing unit and an intermediate tube interposed between an outer periphery of said main housing body and said cover member, and said hollow cavities being formed by way of perforations opened in said intermediate tube or bottomed holes dug into an outer peripheral surface of said intermediate tube.

7. An electrostatic coating apparatus as defined in claim 6, wherein an inner peripheral surface of said intermediate tube is disposed to confront outer peripheral surfaces of said main housing body across an annular gap space which is formed between substantially entire areas of said confronting inner and outer peripheral surfaces of said intermediate tube and said main housing body.

8. An electrostatic coating apparatus as defined in claim 7, wherein a high voltage discharge electrode assembly is provided around an outer periphery of said cover member to discharge a high voltage of a same polarity as said charged paint particles.

9. An electrostatic coating apparatus as defined in claim 8, wherein said high voltage discharge electrode assembly is composed of support arms extended radially outward from said cover member, a ring member supported on outer distal ends of said support arms and located periphery of said paint atomizing unit in such a way as to circumvent said cover member, and an acicular or blade-like electrode member supported on and extended from said ring member in a direction away from said work piece.

10. An electrostatic coating apparatus as defined in claim 7, wherein said paint atomizing unit is composed of an air motor accommodated in said housing member, and a rotary atomizing head rotatably supported on a front side of the air motor and provided with paint releasing edges at a front end thereof.

11. An electrostatic coating apparatus as defined in claim 10, wherein said high voltage application unit applies a high voltage to said air motor and said rotary atomizing head, directly applying the high voltage to paint being supplied to said rotary atomizing head.

12. An electrostatic coating apparatus as defined in claim 10, wherein said high voltage application unit applies a high voltage to an external electrode assembly located radially on an outer side of said cover member, indirectly charging paint particles with the high voltage as the paint particles are sprayed by said rotary atomizing head.

13. An electrostatic coating apparatus as defined in claim 6, wherein a high voltage discharge electrode assembly is provided around an outer periphery of said cover member to discharge a high voltage of a same polarity as said charged paint particles.

14. An electrostatic coating apparatus as defined in claim 13, wherein said high voltage discharge electrode assembly is composed of support arms extended radially outward from said cover member, a ring member supported on outer distal ends of said support arms and located periphery of said paint atomizing unit in such a way as to circumvent said cover member, and an acicular or blade-like electrode member supported on and extended from said ring member in a direction away from said work piece.

15. An electrostatic coating apparatus as defined in claim 6, wherein said paint atomizing unit is composed of an air motor accommodated in said housing member, and a rotary atomizing head rotatably supported on a front side of the air motor and provided with paint releasing edges at a front end thereof.

16. An electrostatic coating apparatus as defined in claim 15, wherein said high voltage application unit applies a high voltage to said air motor and said rotary atomizing head, directly applying the high voltage to paint being supplied to said rotary atomizing head.

17. An electrostatic coating apparatus as defined in claim 15, wherein said high voltage application unit applies a high voltage to an external electrode assembly located radially on an outer side of said cover member, indirectly charging paint particles with the high voltage as the paint particles are sprayed by said rotary atomizing head.

18. An electrostatic coating apparatus comprising:

a paint atomizing unit that sprays atomized paint particles toward a work piece;

a housing member formed of an electrically insulating material that enshrouds said paint atomizing unit;

a tubular cover member that enshrouds outer surfaces of said housing member, the tubular cover member being separate from the housing member; and a high voltage application unit that imparts a high voltage electrostatic charge to paint particles to deposit charged paint particles sprayed from said paint atomizing unit on surfaces of said work piece, wherein a plurality of hollow cavities are formed in and sunken from outer surfaces of said housing member, an inner surface of said cover member is in contact with and enshrouds the plurality of hollow cavities and the outer surfaces of said housing member and closes outer sides of said hollow cavities, defining a closed space in each one of said hollow cavities, a high voltage discharge electrode assembly is provided around an outer periphery of said cover member to discharge a high voltage of a same polarity as said charged paint particles, and said high voltage discharge electrode assembly is composed of support arms extended radially outward from said cover member, a ring member supported on outer distal ends of said support arms and located periphery of said paint atomizing unit in such a way as to circumvent said cover member, and an acicular or blade-like electrode member supported on and extended from said ring member in a direction away from said work piece.

19. An electrostatic counting apparatus comprising:

a paint atomizing unit that sprays atomized paint particles toward a work piece;

a housing member formed of an electrically insulating material that enshrouds said paint atomizing unit;

a tubular cover member that enshrouds outer surfaces of said housing member, the tubular cover member being separate from the housing member; and a high voltage application unit that imparts a high voltage electrostatic charge to paint particles to deposit charged paint particles sprayed from said paint atomizing unit on surfaces of said work piece, wherein a plurality of hollow cavities are formed in and sunken from outer surfaces of said housing member, an inner surface of said cover member is in contact with and enshrouds the plurality of hollow cavities and the outer surfaces of said housing member and closes outer sides of said hollow cavities, defining a closed space in each one of said hollow cavities, and the hollow cavities are entirely closed and are not in fluid communication with the paint atomizing unit.

20. An electrostatic counting apparatus comprising:

a paint atomizing unit that sprays atomized paint particles toward a work piece;

a housing member formed of an electrically insulating material that enshrouds said paint atomizing unit;

a tubular cover member that enshrouds outer surfaces of said housing member, the tubular cover member being separate from the housing member; and a high voltage application unit that imparts a high voltage electrostatic charge to paint particles to deposit charged paint particles sprayed from said paint atomizing unit on surfaces of said work piece, wherein a plurality of hollow cavities are formed in and sunken from outer surfaces of said housing member, an inner surface of said cover member is in contact with and enshrouds the plurality of hollow cavities and the outer surfaces of said housing member and closes outer sides of said hollow cavities, defining a closed space in each one of said hollow cavities, and the hollow cavities extend in a direction perpendicular to the outer surfaces of the housing member.

* * * * *